US009358431B2

(12) United States Patent
Yamamoto

(10) Patent No.: US 9,358,431 B2
(45) Date of Patent: Jun. 7, 2016

(54) GOLF CLUB HEAD WITH REMOVABLE WEIGHT

(71) Applicant: DUNLOP SPORTS CO. LTD., Kobe-shi, Hyogo (JP)

(72) Inventor: Akio Yamamoto, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 0 days.

(21) Appl. No.: 14/139,608

(22) Filed: Dec. 23, 2013

(65) Prior Publication Data

US 2014/0187347 A1 Jul. 3, 2014

(30) Foreign Application Priority Data

Dec. 28, 2012 (JP) ..... 2012-286457

(51) Int. Cl.
*A63B 53/04* (2015.01)

(52) U.S. Cl.
CPC ..... *A63B 53/04* (2013.01); *A63B 53/047* (2013.01); *A63B 53/0466* (2013.01); *A63B 53/0487* (2013.01); *A63B 2053/0433* (2013.01); *A63B 2053/0491* (2013.01)

(58) Field of Classification Search
CPC ..... A63B 53/0466; A63B 53/0491
USPC ..... 473/334, 335, 339, 338, 345, 349
See application file for complete search history.

(56) References Cited

U.S. PATENT DOCUMENTS 2,104,676 A * 1/1938 Senf ..... 211/69.7
3,139,768 A * 7/1964 Biesecker ..... 74/502.4
3,692,306 A * 9/1972 Glover ..... 473/306
6,149,533 A * 11/2000 Finn ..... 473/336
7,166,040 B2 * 1/2007 Hoffman et al. ..... 473/334
7,186,190 B1 * 3/2007 Beach et al. ..... 473/335
7,294,065 B2 * 11/2007 Liang et al. ..... 473/335
7,407,447 B2 * 8/2008 Beach et al. ..... 473/324
7,448,963 B2 * 11/2008 Beach et al. ..... 473/337
7,452,285 B2 * 11/2008 Chao et al. ..... 473/324
7,530,904 B2 * 5/2009 Beach et al. ..... 473/337
7,540,811 B2 * 6/2009 Beach et al. ..... 473/337
7,559,714 B2 * 7/2009 Ruhlander ..... 403/263
7,578,753 B2 * 8/2009 Beach et al. ..... 473/337
7,591,738 B2 * 9/2009 Beach et al. ..... 473/337
7,621,823 B2 * 11/2009 Beach et al. ..... 473/337
7,628,711 B2 * 12/2009 Akinori et al. ..... 473/335

(Continued)

FOREIGN PATENT DOCUMENTS

JP 3142270 U 6/2008
JP 2012-139403 A 7/2012

(Continued)

*Primary Examiner* — William Pierce

(74) *Attorney, Agent, or Firm* — Birch, Stewart, Kolasch & Birch, LLP

(57) ABSTRACT

A head body h1 includes a recess part 14 for a socket. A socket 10 is attached to the recess part 14 for a socket. A weight body 12 is detachably attached to the socket 10. The weight body 12 can be secured by relative rotation of an angle +θ°. The weight body 12 can be detached by relative rotation of an angle−θ°. The weight body 12 includes an engaging part 32. The socket 10 includes a first hole part 18 and a second hole part 20. The engaging part 32 can take an engaging position EP and a non-engaging position NP at the second hole part 20 by the relative rotations. A sectional shape of the engaging part 32 has N-fold rotation symmetry. N is an integer of 1 or greater and 3 or less.

10 Claims, 31 Drawing Sheets

(56) References Cited

U.S. PATENT DOCUMENTS

| | | | | |
|---|---|---|---|---|
| 7,632,194 | B2 * | 12/2009 | Beach et al. | 473/334 |
| 7,686,707 | B2 * | 3/2010 | Matsunaga et al. | 473/332 |
| 7,713,142 | B2 * | 5/2010 | Hoffman et al. | 473/334 |
| 7,717,804 | B2 * | 5/2010 | Beach et al. | 473/337 |
| 7,717,805 | B2 * | 5/2010 | Beach et al. | 473/337 |
| 7,744,484 | B1 * | 6/2010 | Chao | 473/324 |
| 7,771,290 | B2 * | 8/2010 | Bezilla et al. | 473/335 |
| 7,771,291 | B1 * | 8/2010 | Willett et al. | 473/337 |
| 7,846,041 | B2 * | 12/2010 | Beach et al. | 473/334 |
| 7,938,741 | B2 * | 5/2011 | Evans | 473/334 |
| 7,963,861 | B2 * | 6/2011 | Beach et al. | 473/335 |
| 8,052,406 | B2 * | 11/2011 | Li et al. | 418/55.1 |
| 8,182,363 | B2 * | 5/2012 | Bezilla et al. | 473/335 |
| 8,192,302 | B2 * | 6/2012 | Knutson et al. | 473/335 |
| 8,257,196 | B1 * | 9/2012 | Abbott et al. | 473/335 |
| 8,262,507 | B1 * | 9/2012 | Willett et al. | 473/335 |
| 8,562,457 | B2 * | 10/2013 | Beach et al. | 473/335 |
| 8,579,725 | B1 * | 11/2013 | Willett et al. | 473/335 |
| 8,753,222 | B2 * | 6/2014 | Beach et al. | 473/307 |
| 8,753,225 | B1 * | 6/2014 | Abbott et al. | 473/334 |
| 8,758,165 | B1 * | 6/2014 | Abbott et al. | 473/334 |
| 2003/0162608 | A1 * | 8/2003 | Chen | 473/345 |
| 2004/0242343 | A1 * | 12/2004 | Chao et al. | 473/334 |
| 2005/0209021 | A1 * | 9/2005 | Hoffman et al. | 473/334 |
| 2005/0221911 | A1 * | 10/2005 | Beach et al. | 473/338 |
| 2006/0122004 | A1 * | 6/2006 | Chen et al. | 473/335 |
| 2006/0172822 | A1 | 8/2006 | Liang et al. | |
| 2006/0178229 | A1 * | 8/2006 | Liang et al. | 473/334 |
| 2006/0240907 | A1 * | 10/2006 | Latiri | 473/334 |
| 2006/0276263 | A1 * | 12/2006 | Lin et al. | 473/338 |
| 2007/0049400 | A1 * | 3/2007 | Imamoto et al. | 473/329 |
| 2007/0093316 | A1 * | 4/2007 | Yamamoto | 473/345 |
| 2007/0105646 | A1 * | 5/2007 | Beach et al. | 473/329 |
| 2007/0105647 | A1 * | 5/2007 | Beach et al. | 473/334 |
| 2007/0105648 | A1 * | 5/2007 | Beach et al. | 473/334 |
| 2007/0105649 | A1 * | 5/2007 | Beach et al. | 473/334 |
| 2007/0105650 | A1 * | 5/2007 | Beach et al. | 473/336 |
| 2007/0105651 | A1 * | 5/2007 | Beach et al. | 473/336 |
| 2007/0105652 | A1 * | 5/2007 | Beach et al. | 473/336 |
| 2007/0105653 | A1 * | 5/2007 | Beach et al. | 473/336 |
| 2007/0105654 | A1 * | 5/2007 | Beach et al. | 473/336 |
| 2007/0105655 | A1 * | 5/2007 | Beach et al. | 473/336 |
| 2007/0111817 | A1 * | 5/2007 | Chao et al. | 473/336 |
| 2007/0129161 | A1 * | 6/2007 | Matsunaga et al. | 473/332 |
| 2008/0015049 | A1 * | 1/2008 | Imamoto | 473/338 |
| 2008/0039229 | A1 * | 2/2008 | Lo | 473/335 |
| 2008/0261717 | A1 * | 10/2008 | Hoffman et al. | 473/337 |
| 2008/0280698 | A1 * | 11/2008 | Hoffman et al. | 473/337 |
| 2009/0131200 | A1 * | 5/2009 | Akinori et al. | 473/337 |
| 2009/0298612 | A1 * | 12/2009 | Knutson et al. | 473/338 |
| 2010/0048321 | A1 * | 2/2010 | Beach et al. | 473/335 |
| 2010/0311520 | A1 * | 12/2010 | Bezilla et al. | 473/335 |
| 2010/0323815 | A1 * | 12/2010 | Bezilla et al. | 473/335 |
| 2011/0287857 | A1 * | 11/2011 | Beach et al. | 473/335 |
| 2012/0172142 | A1 | 7/2012 | Yashiki | |
| 2012/0202617 | A1 * | 8/2012 | Rice et al. | 473/338 |
| 2013/0150180 | A1 * | 6/2013 | Yamamoto | 473/339 |
| 2013/0324300 | A1 * | 12/2013 | Beach et al. | 473/335 |
| 2014/0018184 | A1 * | 1/2014 | Bezilla et al. | 473/335 |
| 2014/0024475 | A1 * | 1/2014 | Motokawa | 473/338 |
| 2014/0038743 | A1 * | 2/2014 | Nivanh | 473/324 |
| 2014/0179460 | A1 * | 6/2014 | Beach et al. | 473/335 |
| 2014/0187347 | A1 * | 7/2014 | Yamamoto | 473/335 |
| 2014/0235369 | A1 * | 8/2014 | Willett et al. | 473/335 |
| 2014/0248975 | A1 * | 9/2014 | Abbott et al. | 473/332 |
| 2014/0274446 | A1 * | 9/2014 | Greaney et al. | 473/307 |

FOREIGN PATENT DOCUMENTS

| | | |
|---|---|---|
| TW | I251501 B | 3/2006 |
| TW | M339333 U | 9/2008 |

* cited by examiner

N P

N P

E P

E P

GOLF CLUB HEAD WITH REMOVABLE WEIGHT

The present application claims priority on Patent Application No. 2012-286457 filed in JAPAN on Dec. 28, 2012, the entire contents of which are hereby incorporated by reference.

BACKGROUND OF THE INVENTION

1. Field of the Invention

The present invention relates to a golf club head including a weight body.

2. Description of the Related Art

A head capable of replacing a weight body has been known. The position of the center of gravity of the head and the weight of the head can be adjusted by changing the weight of the weight body.

As a mechanism for attaching the weight body, a screw mechanism is typical. Meanwhile, Japanese Utility Model Application Publication No. 3142270 (US2009/0131200) discloses a mechanism including a sleeve and a weight. The gazette discloses a weight detachably attached by rotation.

SUMMARY OF THE INVENTION

In the head of Japanese Utility Model Application Publication No. 3142270, a weight is attached to a sleeve having flexibility. The weight can be detachably attached to the sleeve by the rotation of the weight. When the weight is attached, the weight is rotated in a first direction. When the weight is detached, the weight is rotated in a second direction. The first direction and the second direction are reverse to each other.

When the weight is attached, the weight may be rotated in the direction reverse to the first direction by mistake. When the weight is detached, the weight may be rotated in the direction reverse to the second direction by mistake. Since the sleeve has flexibility, the mistaken reverse rotations cannot be completely prevented. The sleeve is damaged by the mistaken reverse rotations. The damage deteriorates the durability of the sleeve. The deterioration of the sleeve may cause the disengagement of the weight.

It is an object of the present invention to provide a golf club head which is less likely to cause disengagement of a weight body.

A golf club head according to the present invention includes: a head body including a recess part for a socket; a socket attached to the recess part for a socket; and a weight body detachably attached to the socket. The weight body can be secured by relative rotation of an angle +θ° to the socket. The secured weight body can be detached by relative rotation of an angle−θ° to the socket. The weight body includes an engaging part. The socket includes a first hole part and a second hole part positioned on a deeper side than the first hole part. The engaging part can take an engaging position EP and a non-engaging position NP at the second hole part by the relative rotations. Rotation of the weight body in the relative rotations is rotation about an axis line Z. A sectional shape of the engaging part has N-fold rotation symmetry with the axis line Z as a rotation axis. N is an integer of 1 or greater and 3 or less.

Preferably, N is 2.

Preferably, the sectional shape of engaging part is a substantially rectangle.

If the longest rotation radius of the engaging part is defined as R1 and the shortest rotation radius of the engaging part is defined as R2, R1/R2 is preferably 1.30 or greater and 1.70 or less.

A golf club head according to another aspect of the present invention includes: a head body including a recess part for a socket; a socket attached to the recess part for a socket; and a weight body detachably attached to the socket. The weight body can be secured by relative rotation of an angle +θ° to the socket. The secured weight body can be detached by relative rotation of an angle −θ° to the socket. The weight body includes an engaging part. The socket includes a first hole part and a second hole part positioned on a deeper side than the first hole part. The engaging part can take an engaging position EP and a non-engaging position NP at the second hole part by the relative rotations. Rotation of the weight body in the relative rotations is rotation about an axis line Z. The recess part for a socket includes an undercut part. Preferably, the socket includes an engaging projection part. Preferably, the undercut part and the engaging projection part are engaged with each other.

Preferably, the recess part for a socket includes a polygonal inner surface. Preferably, the undercut part is provided on the polygonal inner surface.

Preferably, the socket includes a wall-like part. Preferably, the wall-like part forms an upper end part of the socket. Preferably, the wall-like part includes the engaging projection part.

Preferably, the wall-like part includes a lack part.

An engaging width between the undercut part and the engaging projection part is defined as W1, and a clearance distance between the wall-like part and the weight body is defined as W2. Preferably, the clearance distance W2 is less than the engaging width W1.

Preferably, the engaging width W1 is 0.2 mm or greater and 1.0 mm or less.

DESCRIPTION OF THE PREFERRED EMBODIMENTS

The present invention will be described below in detail based on preferred embodiments with appropriate reference to the drawings.

A golf club head of the present embodiment includes a weight body attaching/detaching mechanism. The mechanism satisfies the Golf Rules defined by R&A (Royal and Ancient Golf Club of Saint Andrews). That is, the weight body attaching/detaching mechanism satisfies requirements specified in "1*b*Adjustability" in "1 Clubs" of "Appendix II Design of Clubs" defined by R&A. The requirements defined by the "1*b*Adjustability" are the following items (i), (ii), and (iii):

(i) the adjustment cannot be readily made;

(ii) all adjustable parts are firmly fixed and there is no reasonable likelihood of them working loose during a round; and (iii) all configurations of adjustment conform with the Rules.

Figure 1:
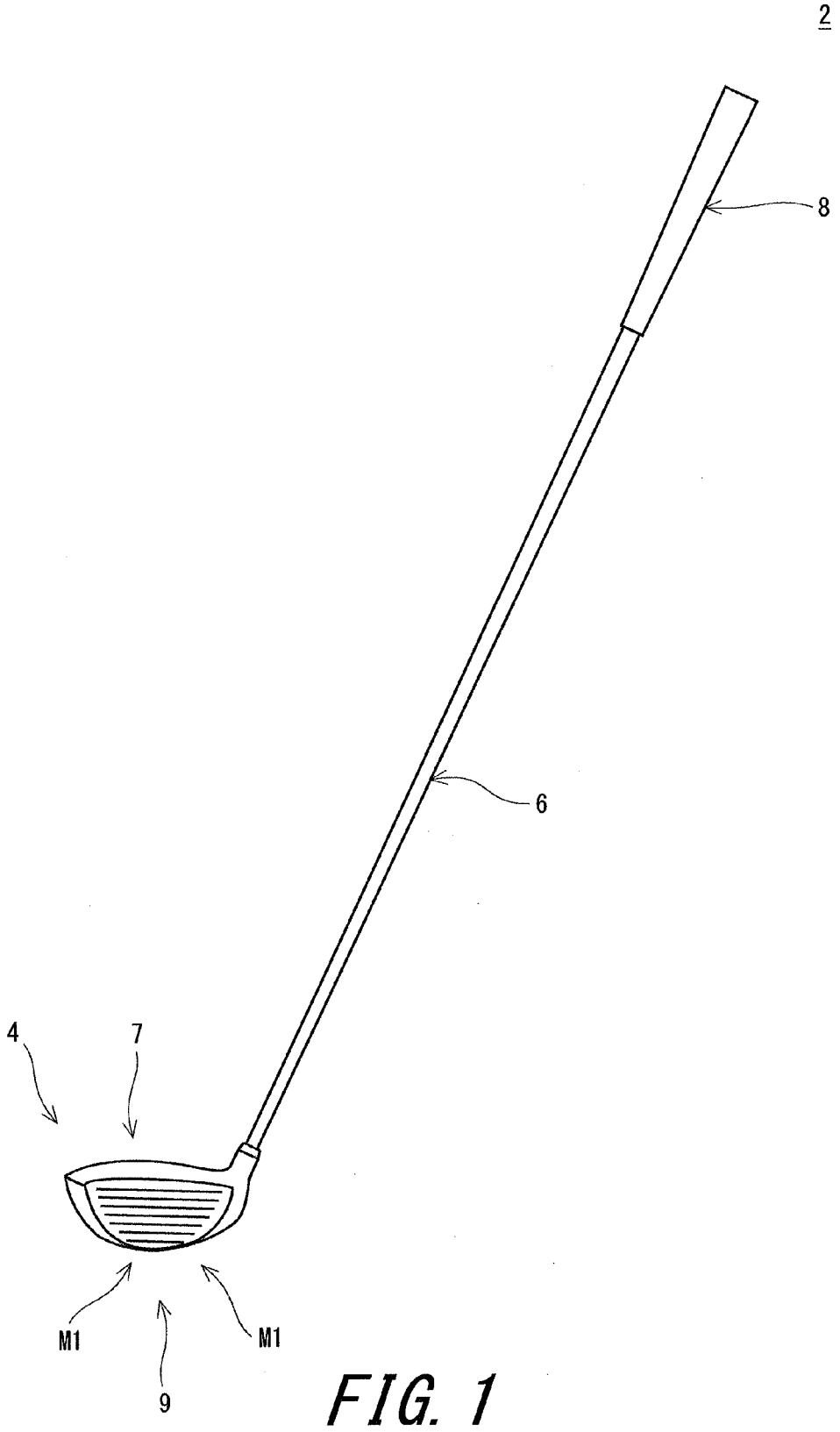
FIG. 1 is an overall view of a golf club including a head according to a first embodiment of the present invention.

FIG. 1 shows a golf club 2 including a head 4 of a first embodiment. The golf club 2 includes the head 4, a shaft 6, and a grip 8. The head 4 is attached to one end part of the shaft 6. The grip 8 is attached to the other end part of the shaft 6. The head 4 includes a crown 7 and a sole 9. The head 4 is hollow.

The head 4 is a wood type head. The real loft angle of the wood type head is usually 8.0 degrees or greater and 34.0 degrees or less. The head volume of the wood type head is usually 120 cc or greater and 470 cc or less.

The head 4 is exemplary. Examples thereof include a utility type head, a hybrid type head, an iron type head, and a putter type head in addition to the wood type head. The shaft 6 is a tubular body. Examples of the shaft 6 include a steel shaft and a so-called carbon shaft.

Figure 2:
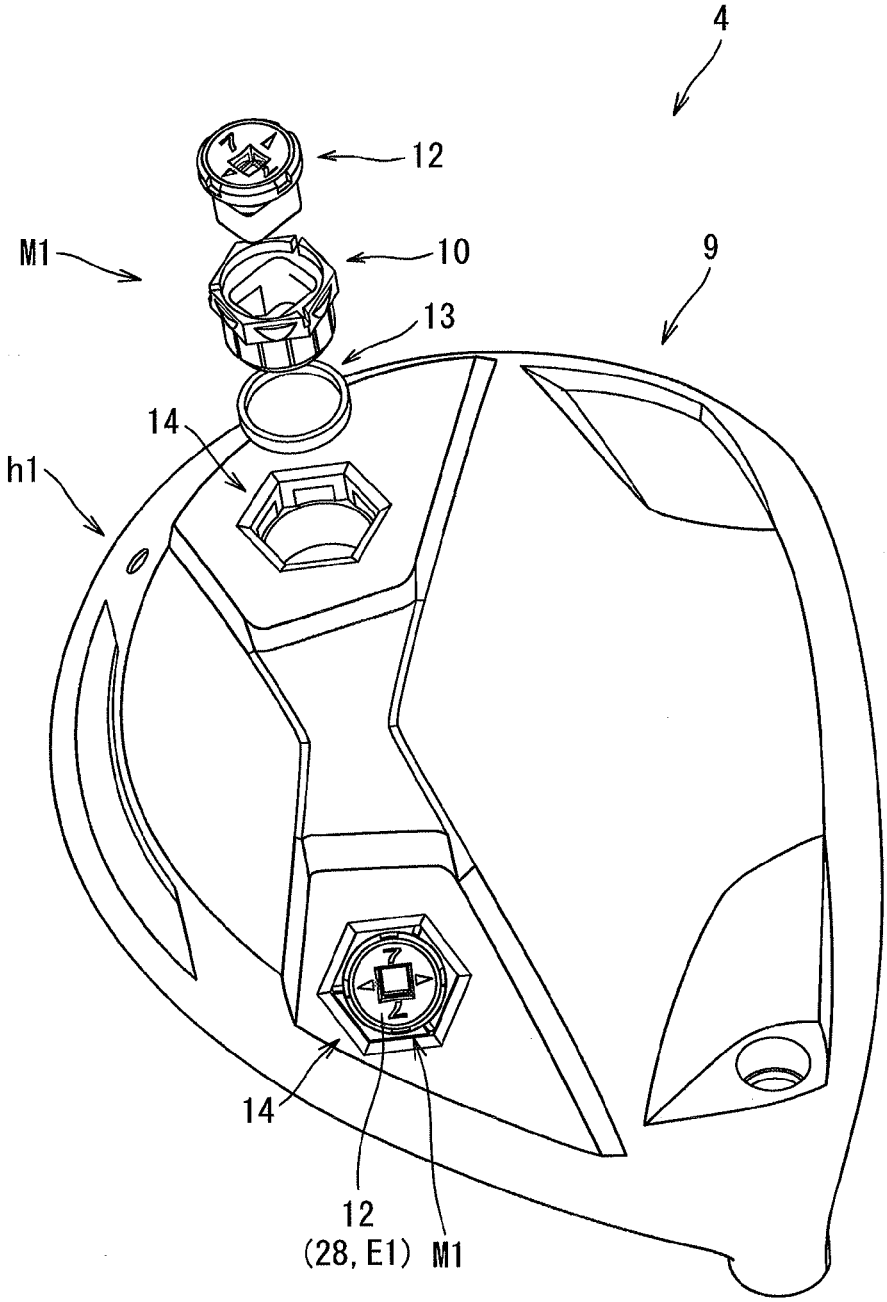
FIG. 2 is a perspective view of the head of FIG. 1, and includes an exploded perspective view of a weight body attaching/detaching mechanism.

FIG. 2 is a perspective view of the head 4 viewed from the sole 9 side. The head 4 includes a head body h1 and a weight body attaching/detaching mechanism M1. The head 4 includes two weight body attaching/detaching mechanisms M1. FIG. 2 includes an exploded perspective view of the weight body attaching/detaching mechanism M1 One of the two weight body attaching/detaching mechanisms M1 is shown in the exploded perspective view.

As shown in FIG. 2, the weight body attaching/detaching mechanism M1 includes a socket 10 and a weight body 12. Furthermore, the weight body attaching/detaching mechanism M1 includes a bottom face forming part 13. The head body h1 includes a recess part 14 for a socket. The recess part 14 for a socket is opened to the outside. The shape of the recess part 14 for a socket corresponds to the shape (outer shape) of the socket 10. The number of the recess parts 14 for a socket is the same as that of the weight body attaching/detaching mechanisms M1 The number of the recess parts 14 for a socket is the same as that of the sockets 10. In the embodiment, two recess parts 14 for a socket are provided. The number of the recess parts 14 for a socket may be 1, may be 2, and may be equal to or greater than 3. The number of the weight body attaching/detaching mechanisms M1 may be 1, may be 2, and may be equal to or greater than 3.

The bottom face forming part 13 can prevent the contact of the weight body 12 to the bottom part of the recess part 14 for a socket. The bottom face forming part 13 may not exist.

Figure 3:
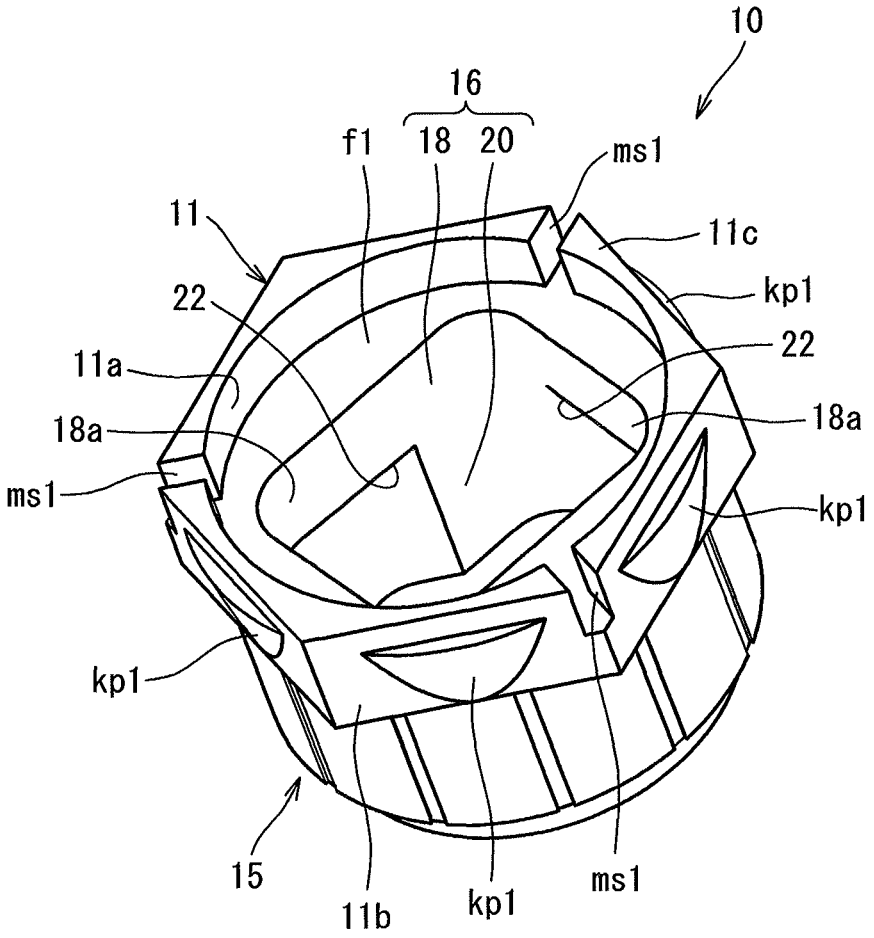
FIG. 3 is a perspective view of a socket.
Figure 4:
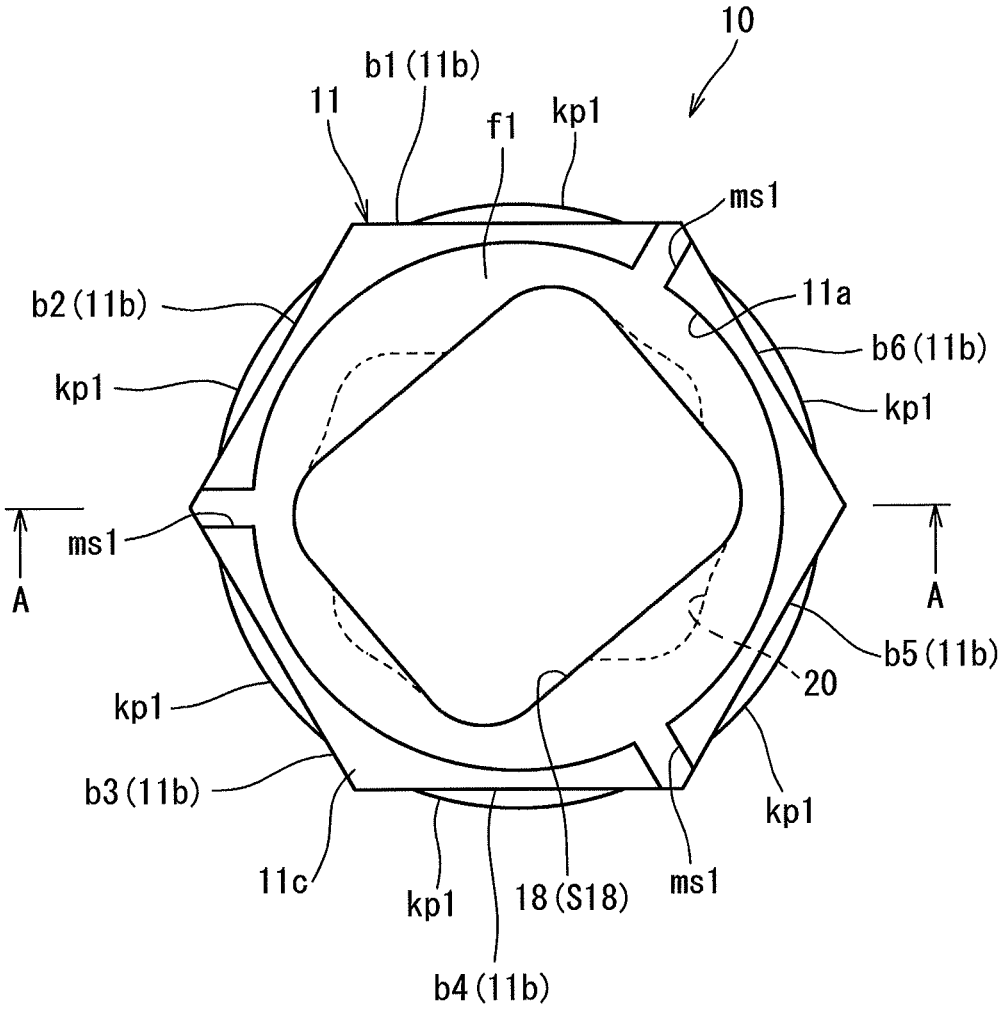
FIG. 4 is a plan view of the socket.
Figure 5A:
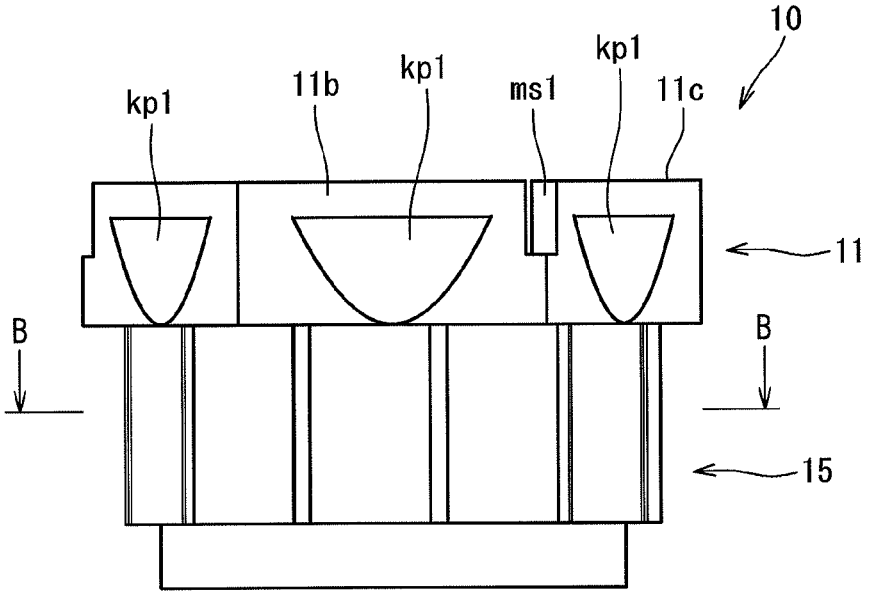
FIGS. 5A and 5B are side views of the socket.
Figure 5B:
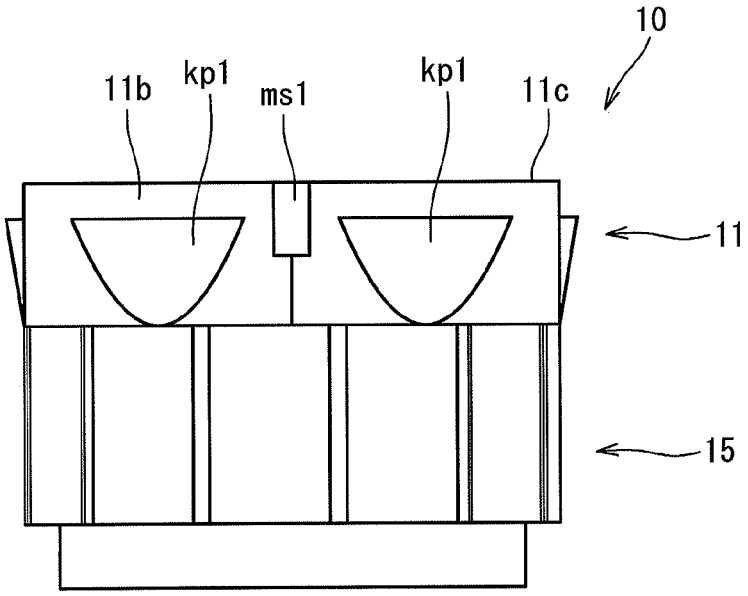
Figure 6:
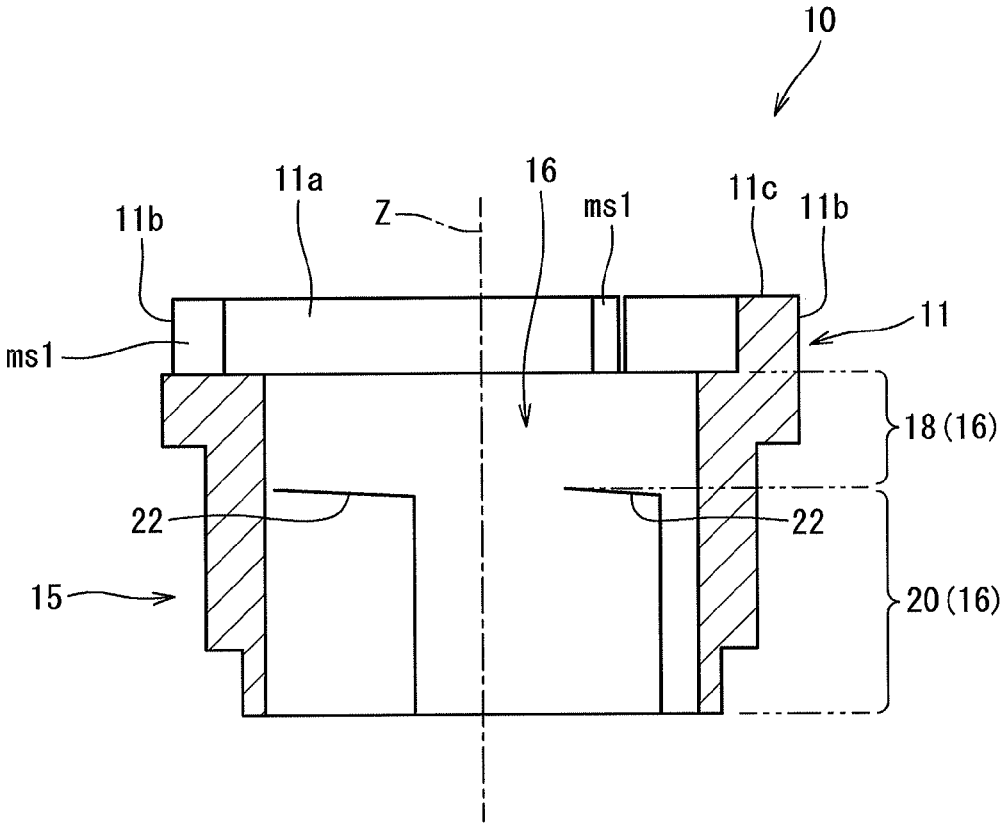
FIG. 6 is a cross-sectional view taken along line A-A of FIG. 4.
Figure 7:
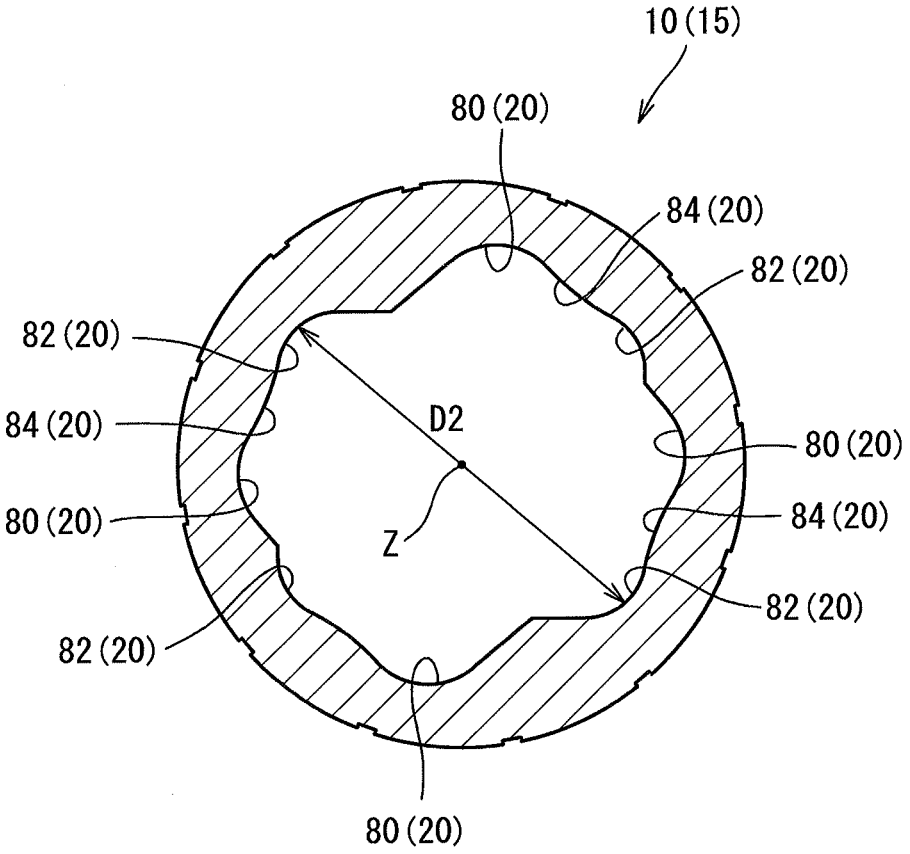
FIG. 7 is a cross-sectional view taken along line B-B FIG. 5.

FIG. 3 is a perspective view of the socket 10. FIG. 4 is a plan view of the socket 10. FIGS. 5A and 5B are side views of the socket 10. The point of view of FIG. 5A is different by 45° from that of FIG. 5B. FIG. 6 is a cross-sectional view taken along line A-A of FIG. 4. FIG. 7 is a cross-sectional view taken along line B-B of FIG. 5A.

The socket 10 includes a wall-like part 11 and a body part 15. The body part 15 includes a hole 16. The hole 16 extends through the body part 15. The wall-like part 11 forms the upper end part of the socket 10. The wall-like part 11 constitutes a portion placed on the most sole surface side in the socket 100. The wall-like part 11 extends toward the upper side (sole surface side) from an opening surface f1 of the hole 16.

The wall-like part 11 includes a lack part ms1. A plurality of lack parts ms1 are provided. In the embodiment, three lack parts ms1 are provided. The lack part ms1 has a slit shape. The lack parts ms1 are provided at every constant angle around an axis line Z (to be described later). In the embodiment, the lack parts ms1 are provided at 120° intervals around the axis line Z (to be described later) (see FIG. 4).

An inner surface 11*a* of the wall-like part 11 is a circumferential surface. The sectional shape of an outer surface 11*b* of the wall-like part 11 is a polygon. Preferably, the polygon is a regular polygon. In the embodiment, the polygon is a regular hexagon. In the polygon, no lack part ms1 exists.

The socket 10 includes an engaging projection part kp1. The engaging projection part kp1 is provided on the wall-like part 11. The socket 10 includes a plurality of engaging projection parts kp1. In the embodiment, six engaging projection parts kp1 are provided (see FIG. 4). The engaging projection part kp1 is provided on each of sides of the polygon. The socket 10 is secured in the recess part 14 for a socket.

The securement is attained by an adhesive, for example. Furthermore, the engaging projection part kp1 contributes to the securement of the socket 10. The details of the function of the engaging projection part kp1 will be described later.

The weight body 12 is detachably attached to the socket 10. Therefore, the weight body 12 is detachably attached to the head 4. The position of the center of gravity of the head can be changed by replacing the weight body 12. The weight of the head can be changed by replacing the weight body 12.

The hole 16 includes a first hole part 18, a second hole part 20, and a bump surface 22. The second hole part 20 is positioned on a deeper side than the first hole part 18. The whole inner surface of the first hole part 18 smoothly continues. In a section perpendicular to the axis line Z, a sectional shape S18 of the inner surface of the first hole part 18 is equal to a sectional shape S32 (to be described later) of an engaging part 32 of the weight body 12. Meanwhile, a sectional shape S20 of the inner surface of the second hole part 20 includes complicated unevenness as shown in FIG. 7. The details of the sectional shape will be described later.

In the embodiment, the sectional shape of the inner surface of the first hole part 18 is a substantially rectangle (see FIG. 4). The substantially rectangle shape is obtained by applying roundness to four corners of the rectangle.

In the application, the insertion direction is an insertion direction of the weight body 12. In the embodiment, the insertion direction coincides with the direction of the axis line Z (to be described later).

Preferably, the material of the socket 10 is a polymer. The polymer is relatively hard. When the weight body 12 is attached/detached, the polymer can be elastically deformed. The attaching/detaching scheme will be described later.

Figure 8:
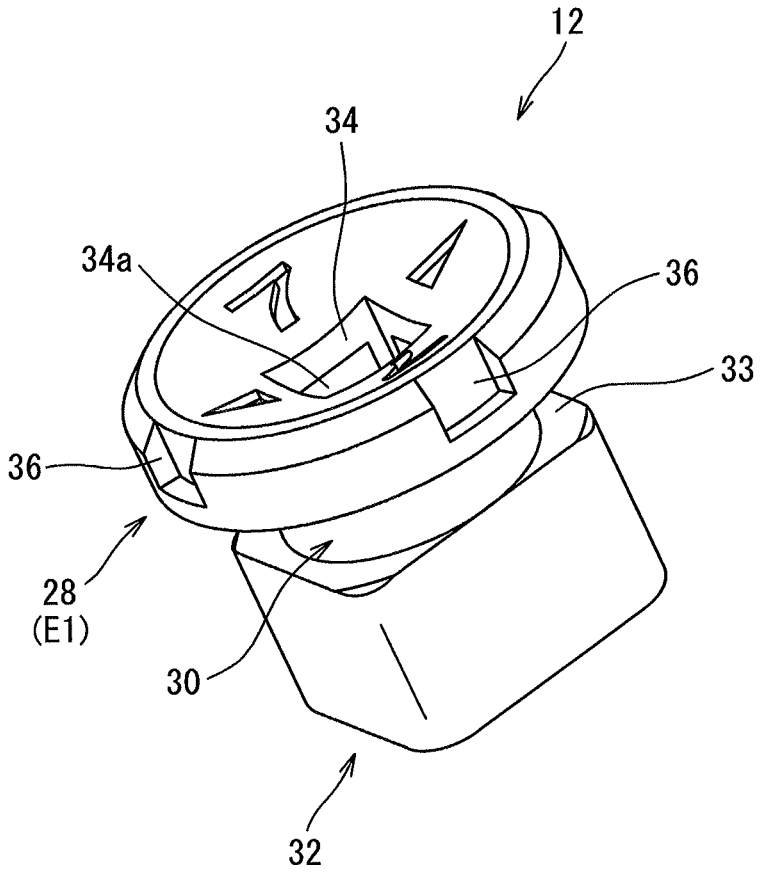
FIG. 8 is a perspective view of a weight body.
Figure 9A:
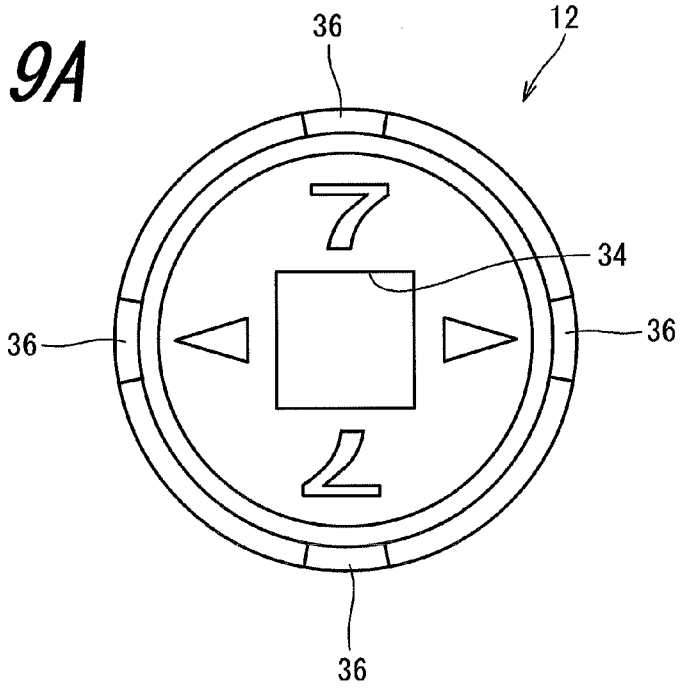
FIG. 9A is a plan view of the weight body.
Figure 9B:
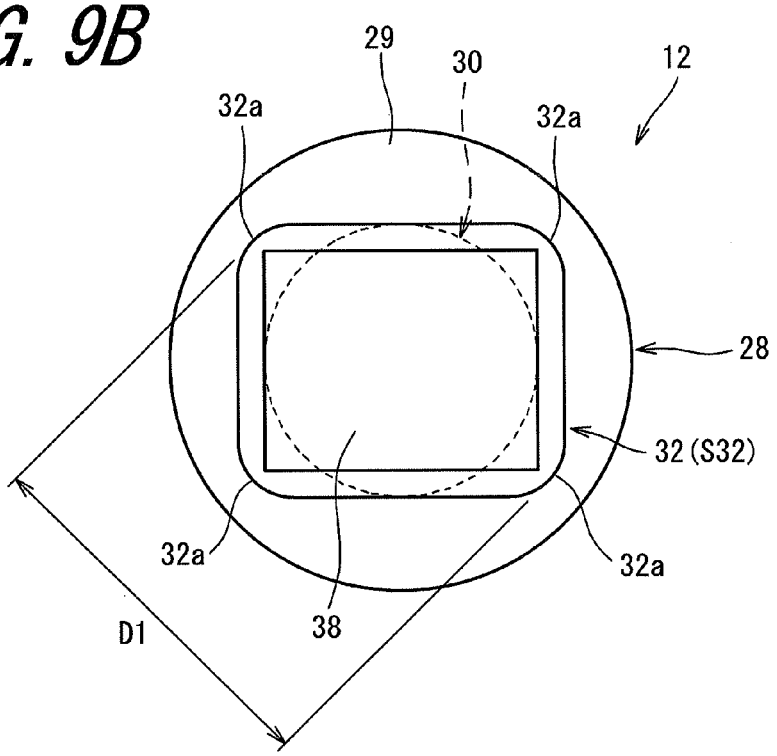
FIG. 9B is a bottom view of the weight body.
Figure 10A:
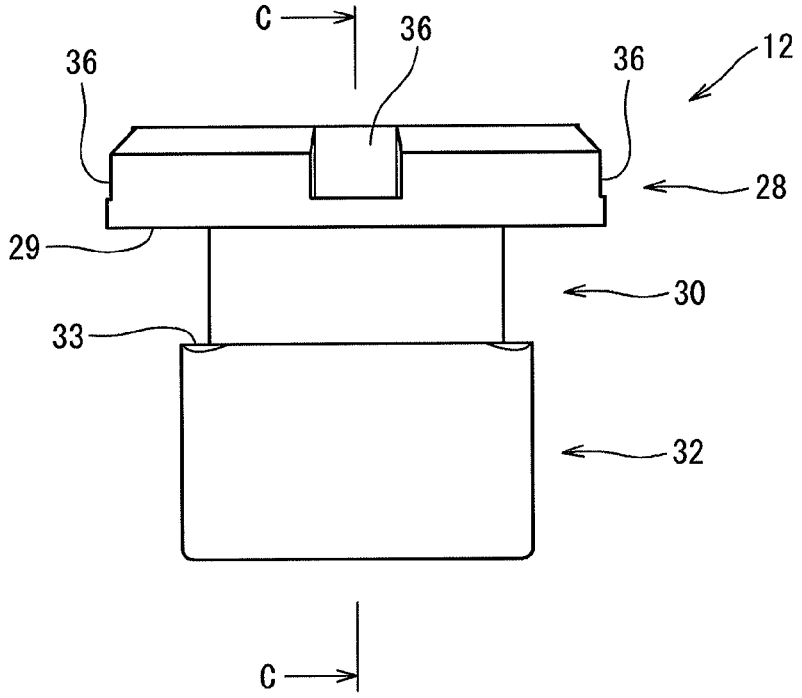
FIGS. 10A and 10B are side views of the weight body.
Figure 10B:
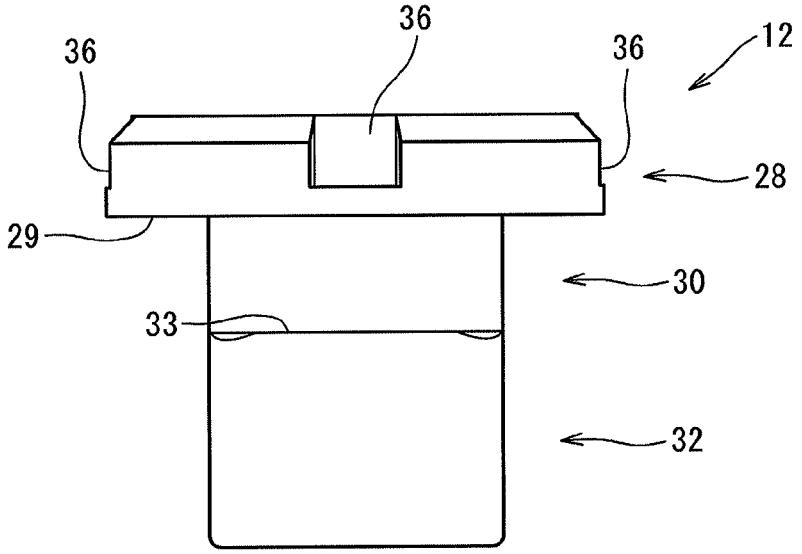
Figure 11:
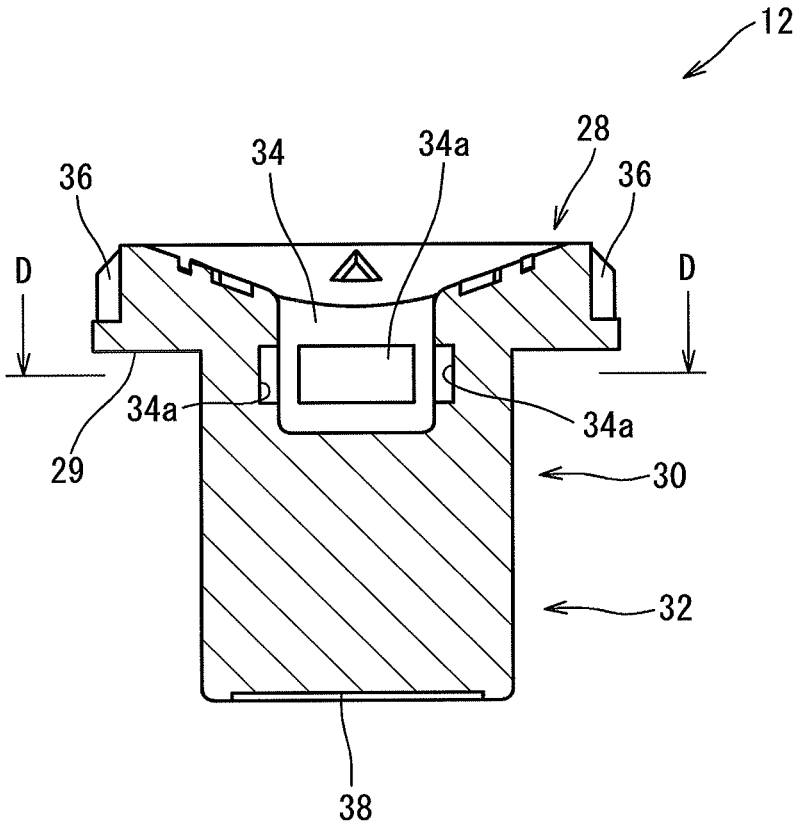
FIG. 11 is a cross-sectional view taken along line C-C of FIG. 10A.
Figure 12:
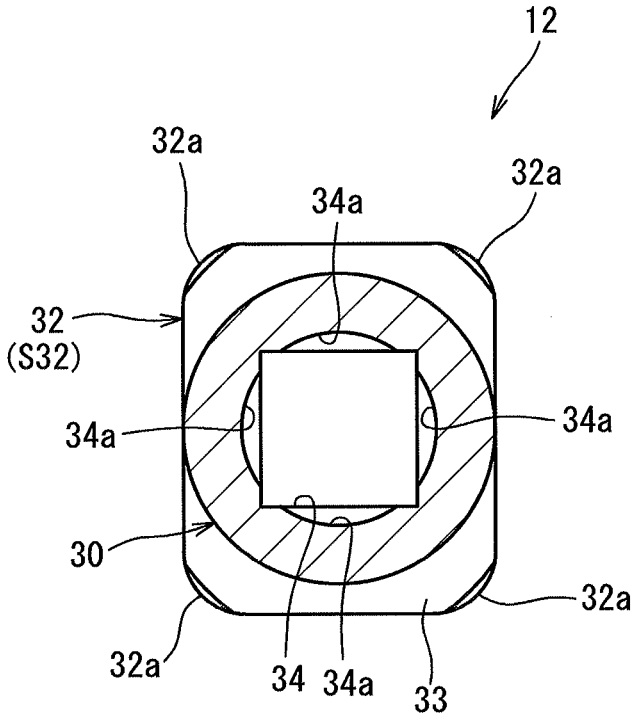
FIG. 12 is a cross-sectional view taken along line D-D of FIG. 11.

FIG. 8 is a perspective view of the weight body 12. FIG. 9A is a plan view of the weight body 12. FIG. 9B is a bottom view of the weight body 12. FIGS. 10A and 10B are side views of the weight body 12. The point of view of FIG. 10A is different by 90° from that of FIG. 10B. FIG. 11 is a cross-sectional view taken along line C-C of FIG. 10A. FIG. 12 is a cross-sectional view taken along line D-D of FIG. 11.

As shown in FIGS. 8, 10A, and 10B, the weight body 12 includes a head part 28, a neck part 30, and the engaging part 32. A noncircular hole 34 is formed at the center of the upper end face of the head part 28. In the embodiment, the noncircular hole 34 has a quadrangle shape. A recess part 34*a* is provided on the inner surface of the noncircular hole 34 (see FIG. 11). A plurality of cutouts 36 are formed in the outer peripheral surface of the head part 28. The outer surface of the neck part 30 is a circumferential surface. The neck part 30 has a cylindrical shape.

The weight body 12 includes an exposed part E1. In the embodiment, the head part 28 is the exposed part E1. The exposed part E1 does not independently contribute to the retention of the weight body 12. In other words, the exposed part E1 does not independently attain the retention. In a lock state (engaging position), the opening surface f1 and the bump surface 22 are held by the exposed part E1 and the engaging part 32. The movement in the insertion direction of the weight body 12 is regulated by the holding. The details of the holding will be described later.

The exposed part E1 is positioned on the outermost side (sole surface side) of the weight body 12. In the lock state, the exposed part E1 is exposed to the outside.

The outer surface of the engaging part 32 has a noncircular sectional shape S32. As shown in FIGs. 9B and 12, in the embodiment, the sectional shape S32 is a substantially rectangle. The sectional shape S32 of the engaging part 32 has a similarity relationship with the sectional shape S18 of the first hole part 18. The sectional shape S32 of the engaging part 32 is (slightly) smaller than the sectional shape S18. The engaging part 32 can pass through the first hole part 18. The sectional shape S32 and the sectional shape S18 include no recess.

As shown in FIG. 11, a recess part 38 is formed in the lower end face of the engaging part 32. The volume of the weight body 12 can be adjusted by the volume of a space formed by the recess part 38 without changing the outer shape of a portion engaged with the socket 10. Therefore, the mass of the weight body 12 can be easily adjusted.

As shown in FIG. 9B, the engaging part 32 includes a corner part 32*a*. A plurality of corner parts 32*a* are provided. In the embodiment, four corner parts 32*a* are provided. The corner part 32*a* protrudes to a direction (hereinafter, also referred to as an axial perpendicular direction) perpendicular to the insertion direction.

The engaging part 32 includes an engaging surface 33 (see FIGS. 8, 10A, and 12). The engaging surface 33 is formed by a difference between the sectional shapes of the engaging part 32 and the neck part 30. The engaging surface 33 is opposed to a lower surface 29 of the head part 28.

Preferably, the weight body 12 has a specific gravity greater than that of the socket 10. In respect of durability and a specific gravity, the material of the weight body 12 is preferably a metal. Examples of the metal include aluminum, an aluminium alloy, titanium, a titanium alloy, stainless steel, a tungsten alloy, and a tungsten nickel alloy (W—Ni alloy). An example of the titanium alloy is 6-4Ti (Ti-6Al-4V). An example of the stainless steel is SUS304.

Examples of a method for manufacturing the weight body 12 include forging, casting, sintering, and NC process. In the case of the aluminium alloy, the 6-4Ti, and the SUS304, the NC process is preferably performed after the casting. In the case of the W—Ni alloy, the NC process is preferably performed after the sintering or the casting. NC stands for "Numerical Control".

Figure 13:
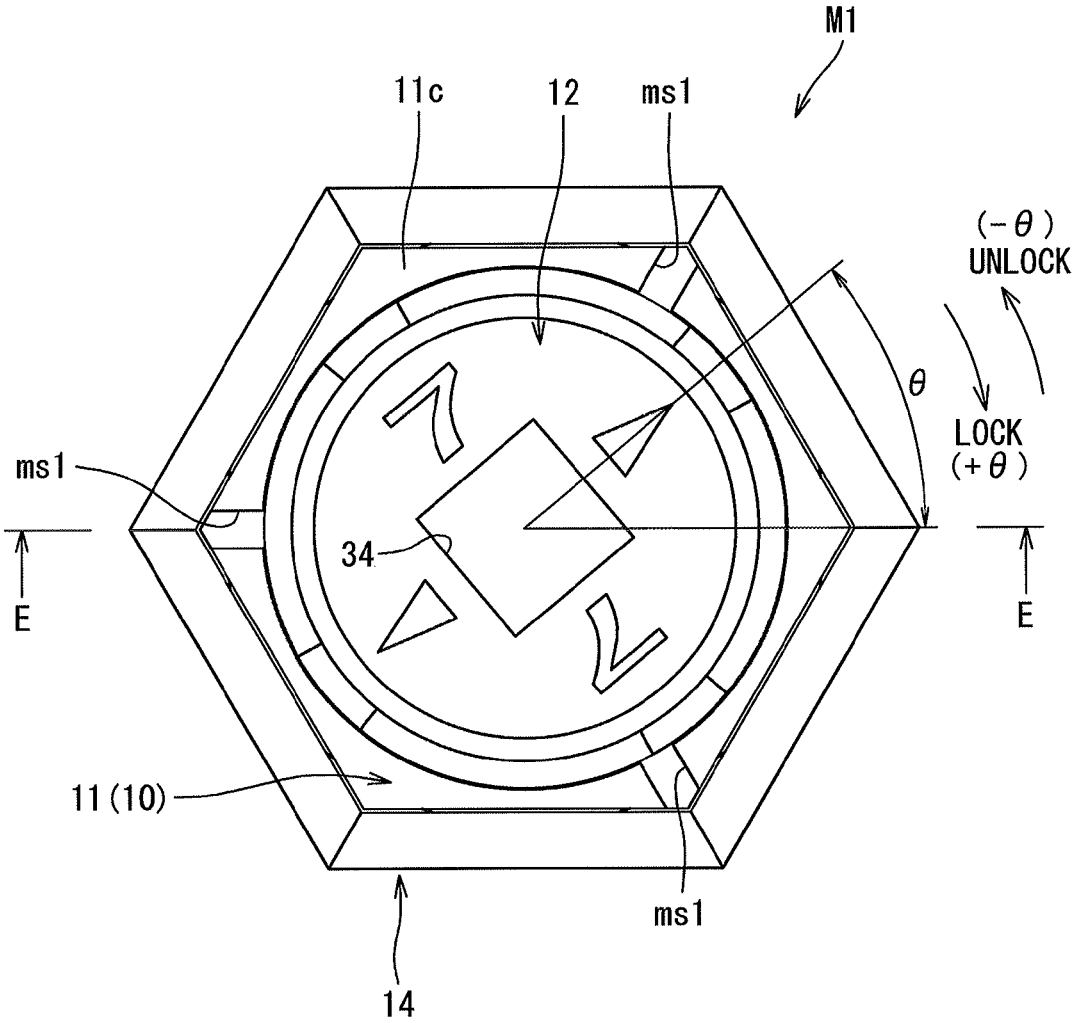
FIG. 13 is a plan view of the weight body attaching/detaching mechanism attached to a recess part for a socket, and is a view at a non-engaging position NP.
Figure 14:
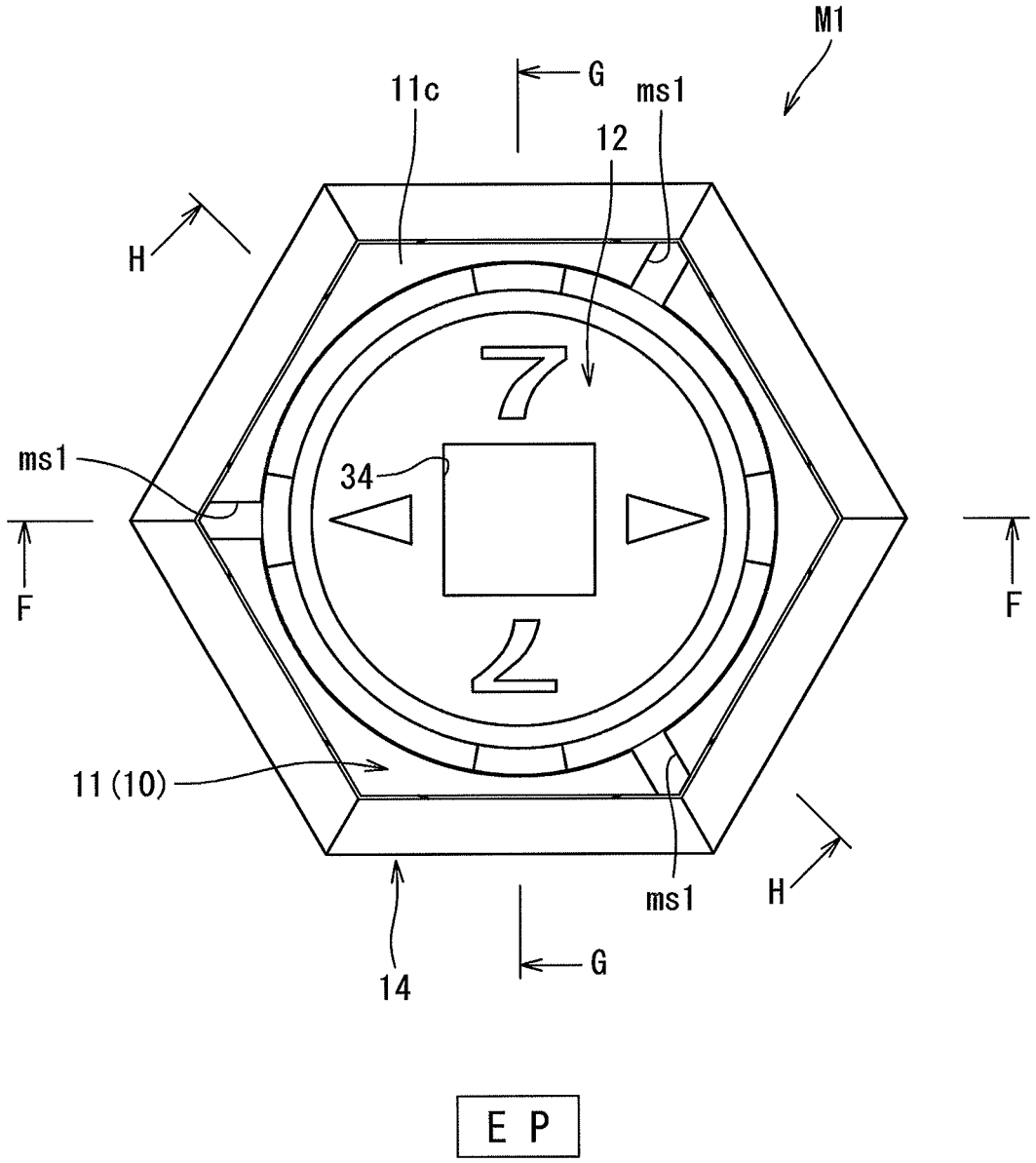
FIG. 14 is a plan view of the weight body attaching/detaching mechanism attached to the recess part for a socket, and is a view at an engaging position EP.

FIG. 13 is a plan view of the weight body attaching/detaching mechanism M1 at a non-engaging position NP. FIG. 14 is a plan view of the weight body attaching/detaching mechanism M1 at an engaging position EP.

As a relative relationship between the socket 10 and the weight body 12, the non-engaging position NP and the engaging position EP can be taken.

At the non-engaging position NP, the weight body 12 can be extracted from the socket 10. At the non-engaging position NP, the weight body 12 is in an unlock state.

Meanwhile, at the engaging position EP, the weight body 12 cannot be extracted from the socket 10. At the engaging position EP, the weight body 12 is secured to the socket 10. At the engaging position EP, the weight body 12 is in a lock state. The weight body 12 which is in a lock state is not disengaged during the use of the club 2.

At the time of inserting the weight body 12 into the socket 10, the relative relationship between the socket 10 and the weight body 12 is the non-engaging position NP. A relative rotation of an angle θ makes the transition to the engaging position EP from the non-engaging position NP. The relative relationship returns to the non-engaging position NP from the engaging position EP with inverse relative rotation of an angle θ. The angle of the relative rotation for making the transition to the engaging position EP from the non-engaging position NP is also described as "+θ" in the present application. The angle of the relative rotation for making the transition to the non-engaging position NP from the engaging position EP is also described as "−θ" in the present application. Signs of "+" and "−" are assigned in order to show that rotation directions are opposite to each other.

In the weight body attaching/detaching mechanism M1, the weight body 12 can be detachably attached by merely applying the rotation of the angle θ. The weight body attaching/detaching mechanism M1 has excellent easiness of attachment/detachment.

In the present application, a state where the weight body 12 is at the engaging position EP is also referred to as a lock state. In the lock state, the exposed part E1 (head part 28) is exposed to the outside (see FIG. 2). In the lock state, an edge face 11*c* (see FIG. 3) of the wall-like part 11 is exposed to the outside. However, the wall-like part 11 does not protrude to the outside of the recess part 14 for a socket.

In the embodiment, the angle θ is 40°. The angle θ is not limited to 40°. In light of the easiness of attachment/detachment, the angle θ is preferably equal to or greater than 20°, and more preferably equal to or greater than 30°. In light of the certainty of the securement, the angle θ is preferably equal to or less than 60°, and more preferably equal to or less than 50°.

Figure 15:
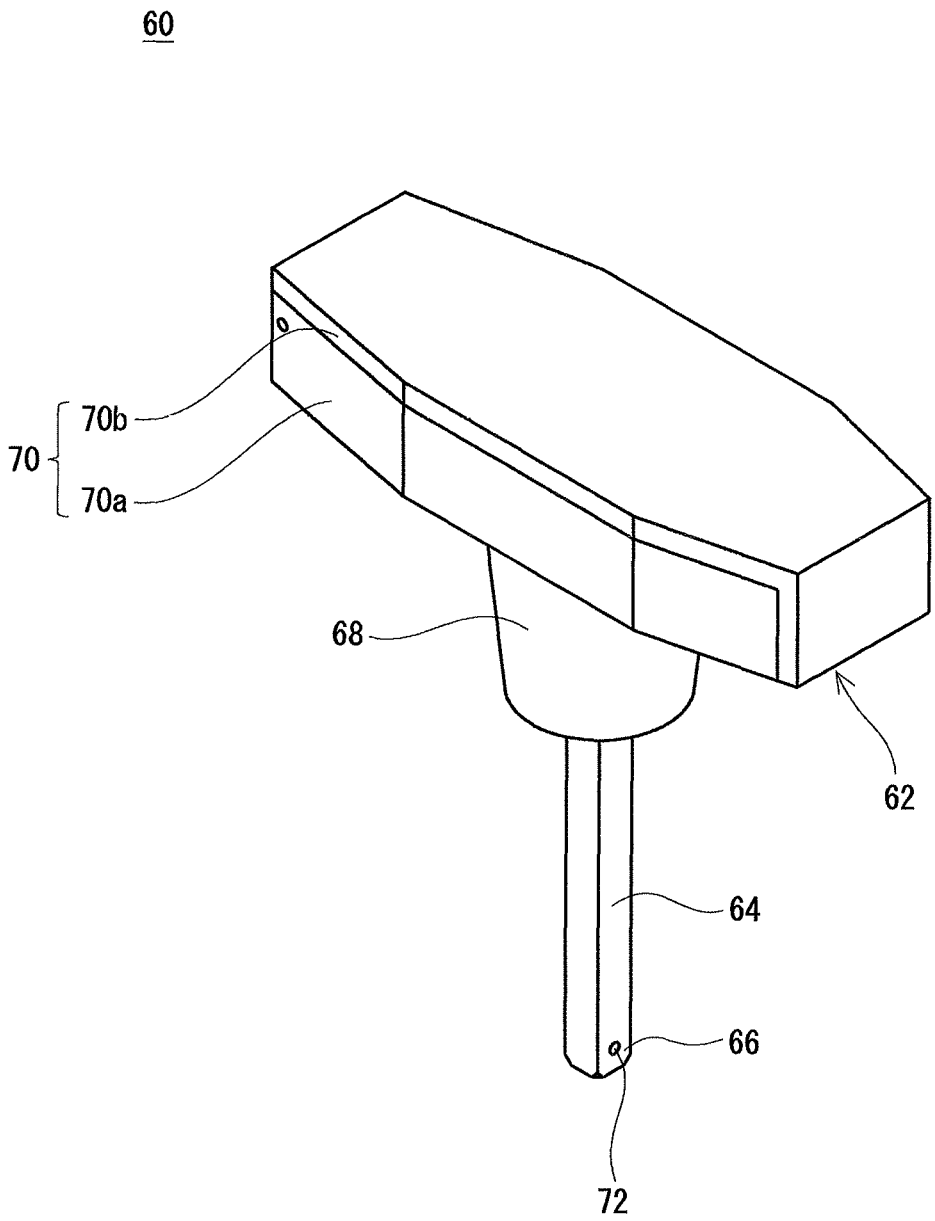
FIG. 15 is a perspective view showing an example of a tool for rotating the weight body.

An exclusive tool can be used to rotate the weight body 12. FIG. 15 is a perspective view showing an example of a tool 60 for rotating the weight body 12. The tool 60 includes a handle 62, a shaft 64, and a tip part 66. The handle 62 includes a handle body 68 and a holding part 70. The holding part 70 includes a holding part body 70*a* and a lid 70*b*.

The back end part of the shaft 64 is secured to the holding part body 70*a*. The sectional shape of the tip part 66 of the shaft 64 corresponds to the sectional shape of the noncircular hole 34 of the weight body 12. In the embodiment, the tip part 66 has a quadrangle sectional shape. A pin 72 is provided on the tip part 66. The pin 72 protrudes from the side surface of the tip part 66. Although not shown in the drawings, an elastic body (coil spring) is built in the tip part 66. The pin 72 is biased in a protruding direction by the biasing force of the elastic body.

When the weight body 12 is attached/detached, the lid 70*b* is closed. A weight body housing part (not shown) is provided in the holding part body 70*a*. Preferably, the weight body housing part can house the plurality of weight bodies 12. The plurality of weight bodies 12 having different weights are preferably housed. The weight bodies 12 can be taken out by opening the lid 70*b*.

The tip part 66 of the tool 60 is inserted into the noncircular hole 34 of the weight body 12 when the weight body 12 is attached. The pin 72 presses the noncircular hole 34 while going backward according to the insertion. The weight body 12 is less likely to be disengaged from the tip part 66 by the pressing force. The pin 72 can enter into the recess part 34*a* (see FIG. 11) of the noncircular hole 34. The weight body 12 is less likely to be disengaged from the tip part 66 by the entering of the pin 72. The weight body 12 held by the shaft 64 of the tool 60 is inserted into the hole 16.

The engaging part 32 of the weight body 12 passes through the first hole part 18 of the hole 16, and leads to the second hole part 20. Immediately after the insertion, the weight body 12 is positioned at the non-engaging position NP.

The relative rotation of the angle +θ° is applied to the weight body 12 positioned at the non-engaging position NP. Specifically, the weight body 12 is rotated by the angle +θ° with respect to the socket 10 using the tool 60. The transition to the engaging position EP from the non-engaging position NP is attained by the rotation.

When the weight body 12 is detached, the reverse rotation of the angle θ° is performed. That is, the rotation of the angle −θ° is performed. The transition to the non-engaging position NP from the engaging position EP is attained by the rotation. The weight body 12 positioned at the non-engaging position NP can be easily extracted. As described above, the pin 72 can enter into the recess part 34*a* (see FIG. 11) of the noncircular hole 34. The weight body 12 is easily extracted by the entering of the pin 72.

At the engaging position EP, the weight body 12 cannot be extracted from the hole 16. The extraction of the weight body 12 is inhibited by engaging the bump surface 22 of the hole 16 with the engaging surface 33 of the weight body 12 at the engaging position EP. The tool 60 can be easily extracted from the noncircular hole 34 of the weight body 12 at the engaging position EP.

Figure 16:
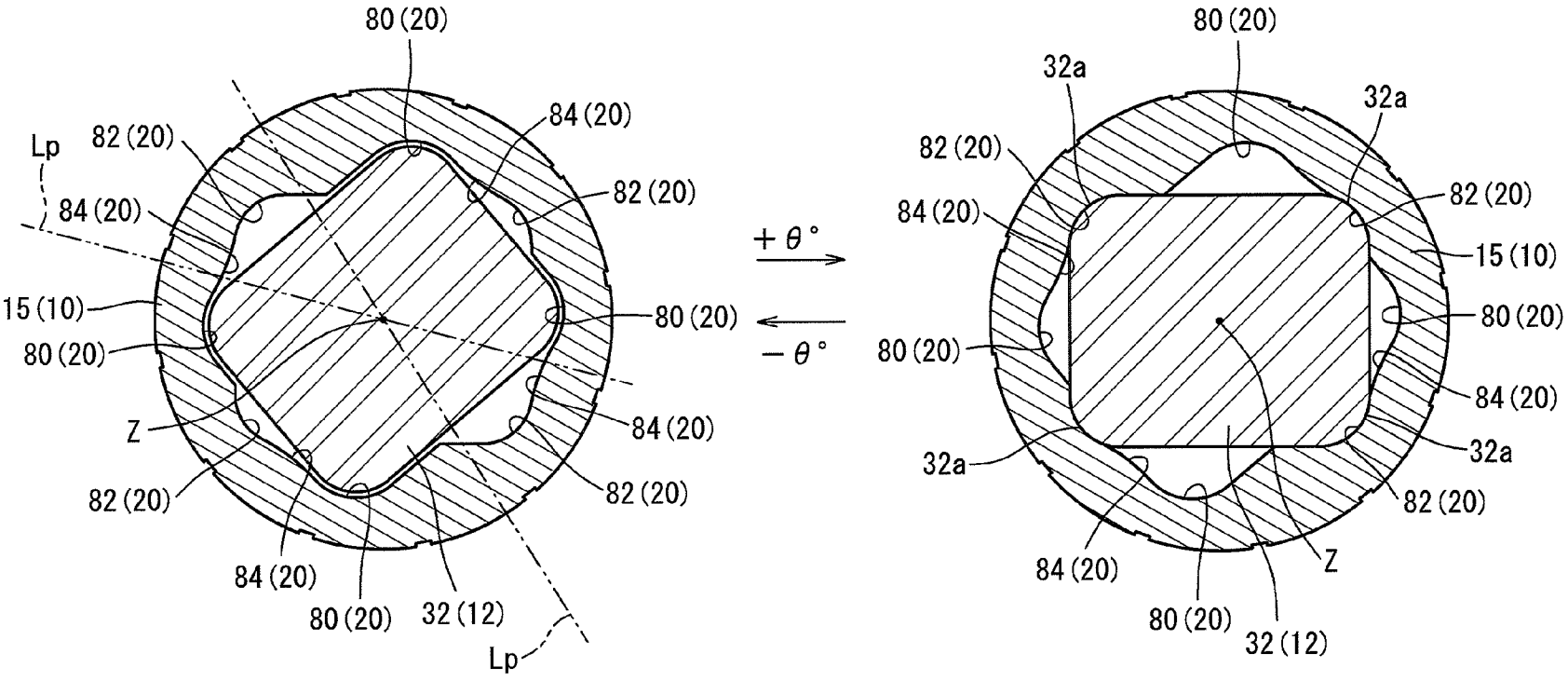
FIG. 16 is a cross-sectional view showing a second hole part and an engaging part, and shows the non-engaging position NP and the engaging position EP.

FIG. 16 is a cross-sectional view showing the engaging part 32 and the socket 10. A cross-sectional view at the non-engaging position NP is shown on the left side of FIG. 16. A cross-sectional view at the engaging position EP is shown on the right side of FIG. 16. The axis line Z which is the center axis of the rotation of the angle θ° is shown by a point in FIG. 16. The center of figure of the section of the outline of the engaging part 32 is positioned on the axis line Z. The rotation of the weight body 12 in the relative rotation is rotation about the axis line Z.

As shown in FIGs. 7 and 16, the second hole part 20 of the socket 10 includes a non-engaging corresponding surface 80, an engaging corresponding surface 82, and a resistance surface 84. The non-engaging corresponding surface 80 is a surface corresponding to the engaging part 32 at the non-engaging position NP. The engaging corresponding surface 82 is a surface corresponding to the engaging part 32 at the engaging position EP. The resistance surface 84 is positioned between the non-engaging corresponding surface 80 and the engaging corresponding surface 82.

The resistance surface 84 is pressed by (the corner part 32*a* of) the engaging part 32 during the mutual transition of the non-engaging position NP and the engaging position EP. A frictional force is generated between the engaging part 32 and the second hole part 20 by the pressing. The resistance surface 84 is elastically deformed by the pressing. The material of the second hole part 20 is a relatively hard polymer, and thereby the frictional force is increased. The frictional force generates a rotation resistance. The increased frictional force generates an increased rotation resistance. A relatively strong torque is required for the mutual transition of the non-engaging position NP and the engaging position EP by the rotation resistance. Therefore, the mutual transition does not easily take place. The mutual transition is not generated by an impact force in hitting. The tool 60 is required for the mutual transition. The mutual transition cannot be attained with empty hands without using the tool 60. The weight body 12 positioned at the engaging position EP is not separated by strong impact shock in hitting.

In the mutual transition of the non-engaging position NP and the engaging position EP, a torque required to rotate the weight body 12 is local maximum when the resistance surface 84 is elastically deformed. The torque required to rotate the weight body 12 is local maximum during the mutual transition of the non-engaging position NP and the engaging position EP. Therefore, the transition to the non-engaging position NP from the engaging position EP does not easily take place. The local maximum torque contributes to the prevention of the separation of the weight body 12 positioned at the engaging position EP.

As shown in FIG. 16, the resistance surface 84 includes a convex-like part. The convex-like part is formed by a smooth curved surface. The convex-like part has a small height. The rotation resistance generated during the mutual transition is increased by the convex-like part. The convex-like part (contributes to the prevention of the separation of the weight body 12 positioned at the engaging position EP.

Thus, the weight body 12 can be detached/attached by merely performing the relative rotation of the angle θ in the weight body attaching/detaching mechanism M1 In addition, the weight body 12 is certainly secured at the engaging position EP.

The engaging part 32 does not deform the second hole part 20 at the engaging position NP. As shown in the left view of FIG. 16, at the non-engaging position NP, a clearance exists between the engaging part 32 and the second hole part 20. The weight body 12 is easily inserted and taken out at the non-engaging position NP because of the clearance. Meanwhile, as shown in the right view of FIG. 16, at the engaging position EP, all the corner parts 32*a* adhere tightly to the second hole part 20 without clearance. In other words, in all the corner parts 32*a*, at least a part of the corner parts 32*a* are contact parts. The contact part is a portion contacting tightly to the second hole part 20 at the engaging position EP. Thus, the engaging part 32 includes a plurality of contact parts. These contact parts cause the extension of the second hole part 20 at the engaging position EP. The engaging corresponding surface 82 is pressed by the corner part 32*a*, and the second hole part 20 is elastically deformed by the pressing. The engaging corresponding surface 82 is elastically deformed.

The second hole part 20 is extended by the elastic deformation. The distance between the two engaging corresponding surfaces 82 opposed to each other is extended by the elastic deformation. The size of the engaging part 32 and the size of the second hole part 20 are determined so that the distance can be extended.

Thus, in the weight body attaching/detaching mechanism M1, the following constitutions A and B are attained. The effect of further certainly securing the weight body 12 is exhibited by the constitution A. Attaching/detaching work is facilitated by the constitution B.

[Constitution A]: At the engaging position EP, the engaging part 32 elastically deforms the socket 10, and the second hole part 20 is extended by the elastic deformation.

[Constitution B]: At the non-engaging position NP, the engaging part 32 does not elastically deform the socket 10.

In the embodiment, the maximum value Dx of the extended distance is 0.04 mm. That is, if the length of a diagonal line in the section of the engaging part 32 is defined as D1, and an opposed distance between the two engaging corresponding surfaces 82 at a position corresponding to the diagonal line is defined as D2, the length D1 is greater by 0.04 mm than the distance D2. The length D1 is shown by a double pointed arrow in FIG. 9B. The length D1 is the maximum length of a line segment crossing the section of the engaging part 32. The distance D2 is shown by a double pointed arrow in FIG. 7.

In respect of the securement of the weight body 12, the maximum value Dx is preferably equal to or greater than 0.01 mm, and more preferably equal to or greater than 0.02 mm. In respect of suppressing the deterioration of the socket 10 caused by repeated deformation, the maximum value Dx is preferably equal to or less than 0.10 mm, and more preferably equal to or less than 0.08 mm.

Figure 17:
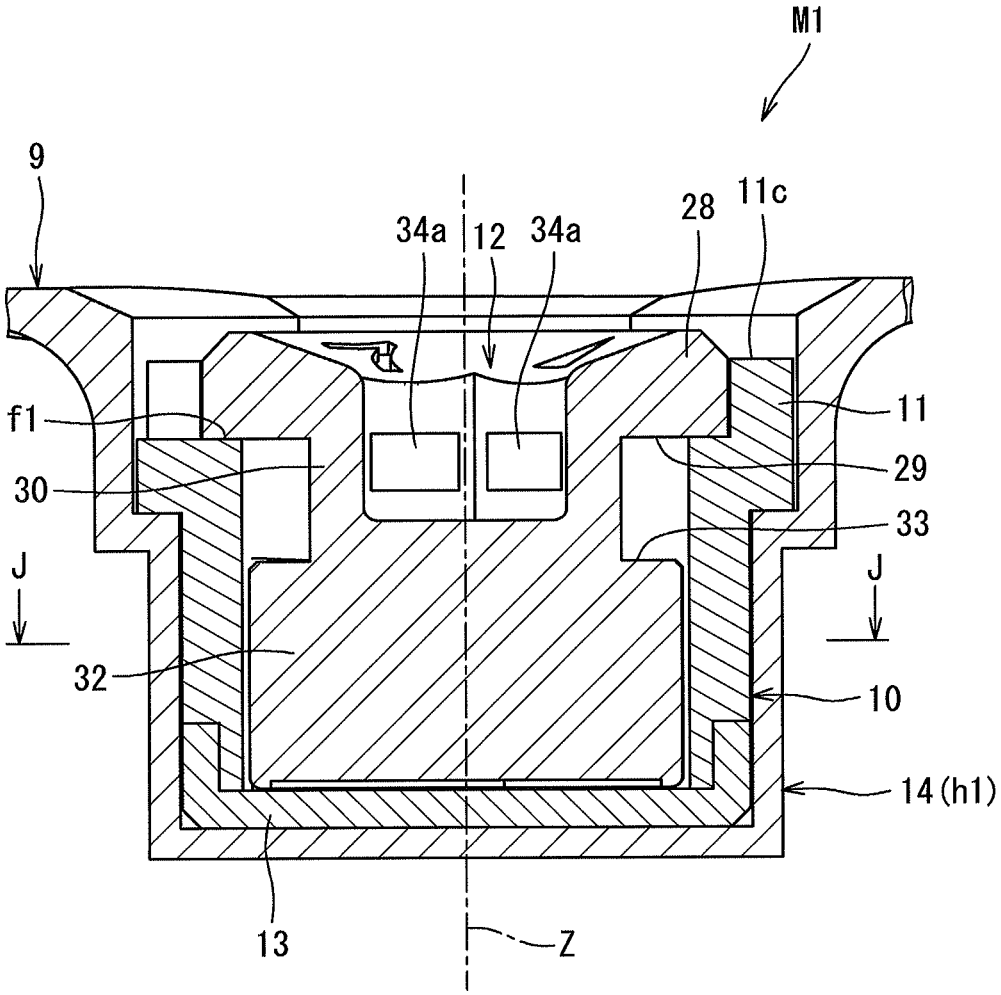
FIG. 17 is a cross-sectional view taken along line E-E of FIG. 13.
Figure 18:
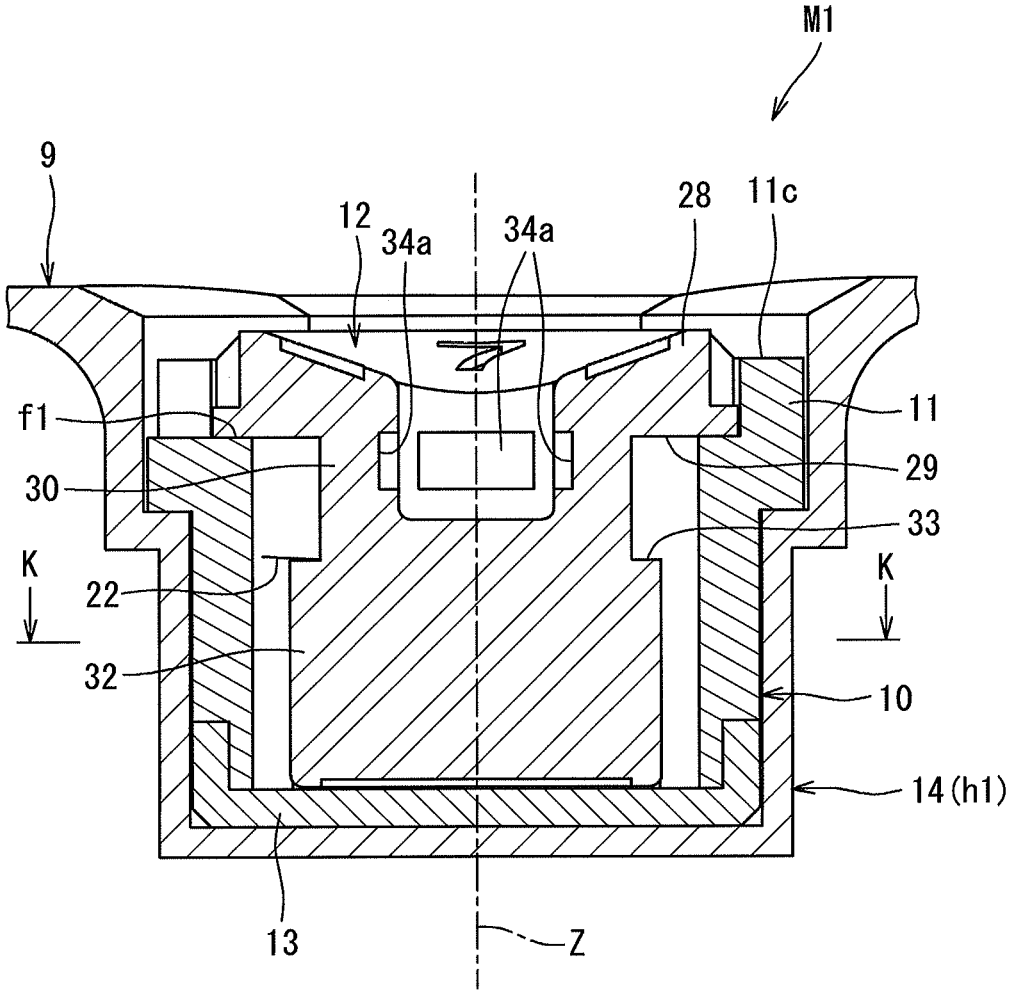
FIG. 18 is a cross-sectional view taken along line F-F of FIG. 14.
Figure 19:
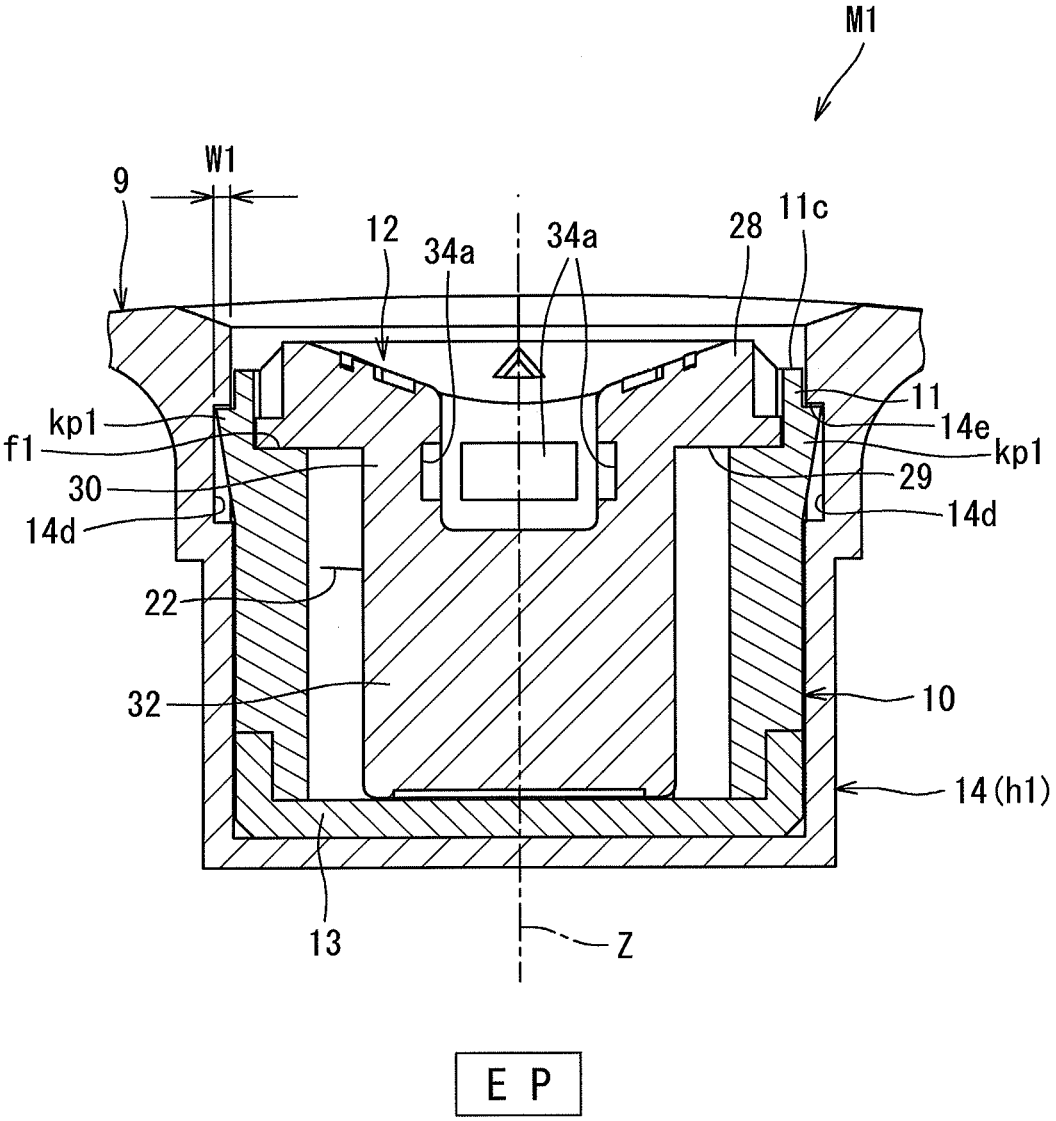
FIG. 19 is a cross-sectional view taken along line G-G of FIG. 14.
Figure 20:
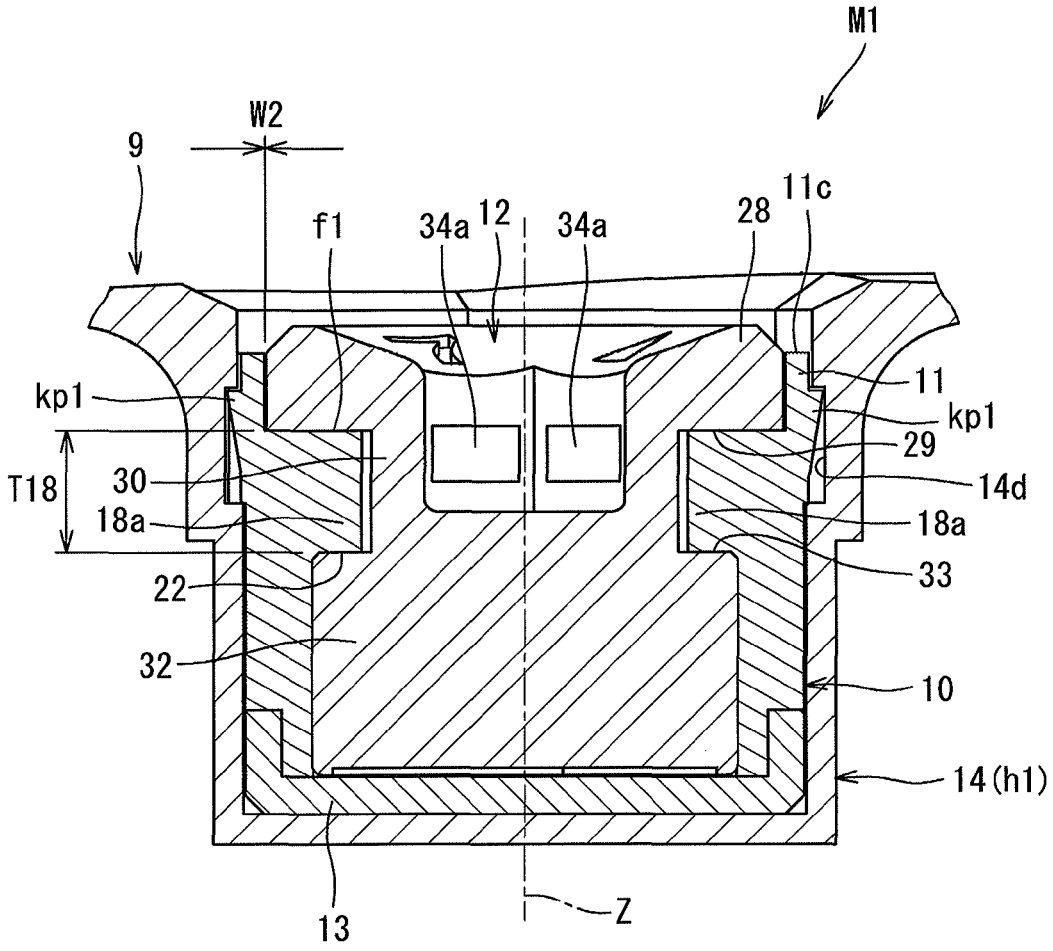
FIG. 20 is a cross-sectional view taken along line H-H of FIG. 14.

FIG. 17 is a cross-sectional view taken along line E-E of FIG. 13. FIG. 17 is a cross-sectional view at the non-engaging position NP. FIG. 18 is a cross-sectional view taken along line F-F of FIG. 14. FIG. 18 is a cross-sectional view at the engaging position EP. FIG. 19 is a cross-sectional view taken along line G-G of FIG. 14. FIG. 19 is a cross-sectional view in at the engaging position EP. FIG. 20 is a cross-sectional view taken along line H-H of FIG. 14. FIG. 20 is a cross-sectional view at the engaging position EP.

Figure 21:
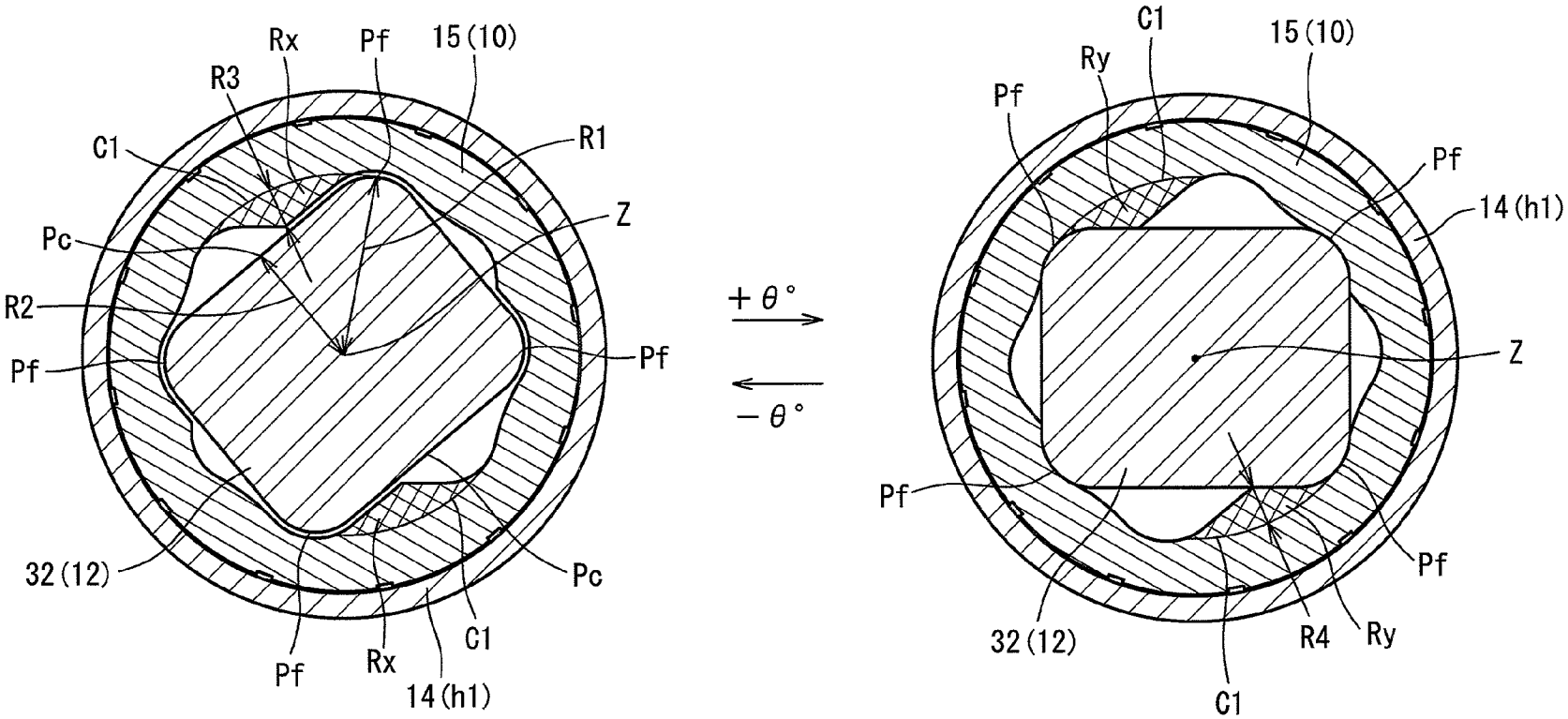
FIG. 21 shows cross-sectional views at the non-engaging position NP and the engaging position EP, wherein a left side of FIG. 21 is a cross-sectional view taken along line J-J of FIG. 17, and a right side of FIG. 21 is a cross-sectional view taken along line K-K of FIG. 18.

FIG. 21 is a cross-sectional view showing the mutual transition between the engaging position EP and the non-engaging position NP. A left side of FIG. 21 is a cross-sectional view taken along line J-J of FIG. 17, and is a cross-sectional view at the non-engaging position NP. Aright side of FIG. 21 is a cross-sectional view taken along line K-K of FIG. 18, and is a cross-sectional view at the engaging position EP.

As described above, the socket 10 includes the first hole part 18 and the second hole part 20. The sectional shape of the first hole part 18 is different from that of the second hole part 20. The difference causes the formation of the bump surface 22.

As shown in FIG. 20, the first hole part 18 includes an inner protruding part 18*a*. The upper surface of the inner protruding part 18*a* is the opening surface f1. The lower surface of the inner protruding part 18*a* is the bump surface 22.

At the non-engaging position NP, the inner protruding part 18*a* is not engaged with the weight body 12. Meanwhile, at the engaging position EP, the inner protruding part 18*a* is engaged with the weight body 12. That is, as shown in FIG. 20, the inner protruding part 18*a* is sandwiched between the lower surface 29 and the engaging surface 33. Therefore, the weight body 12 is certainly secured.

The axial-directional thickness of the inner protruding part 18*a* is shown by a double pointed arrow T18 in FIG. 20. As shown in FIG. 6, the bump surface 22 is inclined. The inclination causes a change in the axial-directional thickness T18. As the weight body 12 is rotated to the engaging position EP, the axial-directional thickness T18 of a portion engaged with the weight body 12 is increased. At the engaging position EP, the inner protruding part 18*a* is compressively deformed so that the thickness T18 is decreased. The pressing force is applied to the lower surface 29 and the engaging surface 33 from the inner protruding part 18*a* by the restoring force of the compressive deformation. For this reason, the weight body 12 is further certainly secured.

Thus, in the weight body attaching/detaching mechanism M1, the following constitutions C, D, and F are attained. The effect of further certainly securing the weight body 12 is exhibited by the constitution C. Attaching/detaching work is facilitated by the constitutions D and E.

[Constitution C]: At the engaging position EP, the weight body 12 holds the inner protruding part 18*a* of the socket 10, and compressively deforms the inner protruding part 18*a*.

[Constitution D]: As the weight body 12 gets closer to the engaging position EP in a process to the engaging position EP from the non-engaging position NP, the compressive deformation amount of the inner protruding part 18*a* is increased.

[Composition E]: At the non-engaging position NP, the compressive deformation of the inner protruding part 18*a* is not produced.

A portion shown by crosshatching on the left side (non-engaging position NP) of FIG. 21 is a reverse rotation suppressing part Rx. A circular arc C1 determining the reverse rotation suppressing part Rx is a part of a circle including the axis line Z as a central point, wherein a distance between the central point Z and a point Pf is defined as a radius R1. The point Pf is the point farthest from the point Z in the outline of the section of the engaging part 32. The reverse rotation suppressing part Rx can prevent reverse rotation in locking. The reverse rotation suppressing part Rx prompts correct rotation (rotation of)+θ° to the engaging position EP.

A portion shown by crosshatching on the right side (engaging position. EP) of FIG. 21 is an excess rotation suppressing part Ry. The circular arc C1 determining the excess rotation suppressing part Ry is as described above. The excess rotation suppressing part Ry can prevent excess rotation in locking.

The excess rotation suppressing part Ry suppresses further excess rotation of the engaging part 32 beyond the engaging position EP when the engaging part 32 lead to the engaging position EP, to prompt the attainment of the engaging position EP.

In the embodiment, the excess rotation suppressing part Ry is the same as the reverse rotation suppressing part Rx. However, the excess rotation suppressing part Ry is compressed by the engaging part 32, and is slightly deformed. Meanwhile, the compressive deformation is not generated in the reverse rotation suppressing part Rx.

Figure 22:
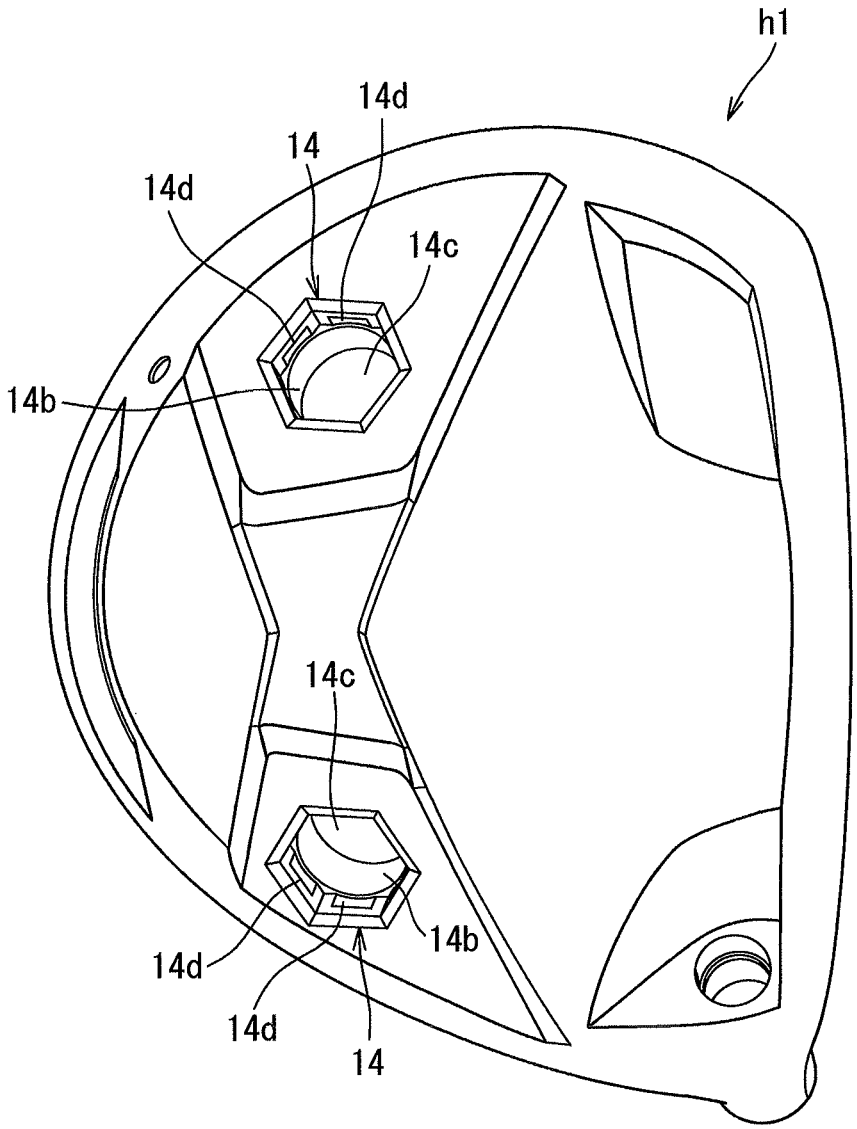
FIG. 22 is a perspective view of a head body.

FIG. 22 is a perspective view of the head body h1. As described above, the head body h1 includes the two recess parts 14 for a socket.

Figure 23:
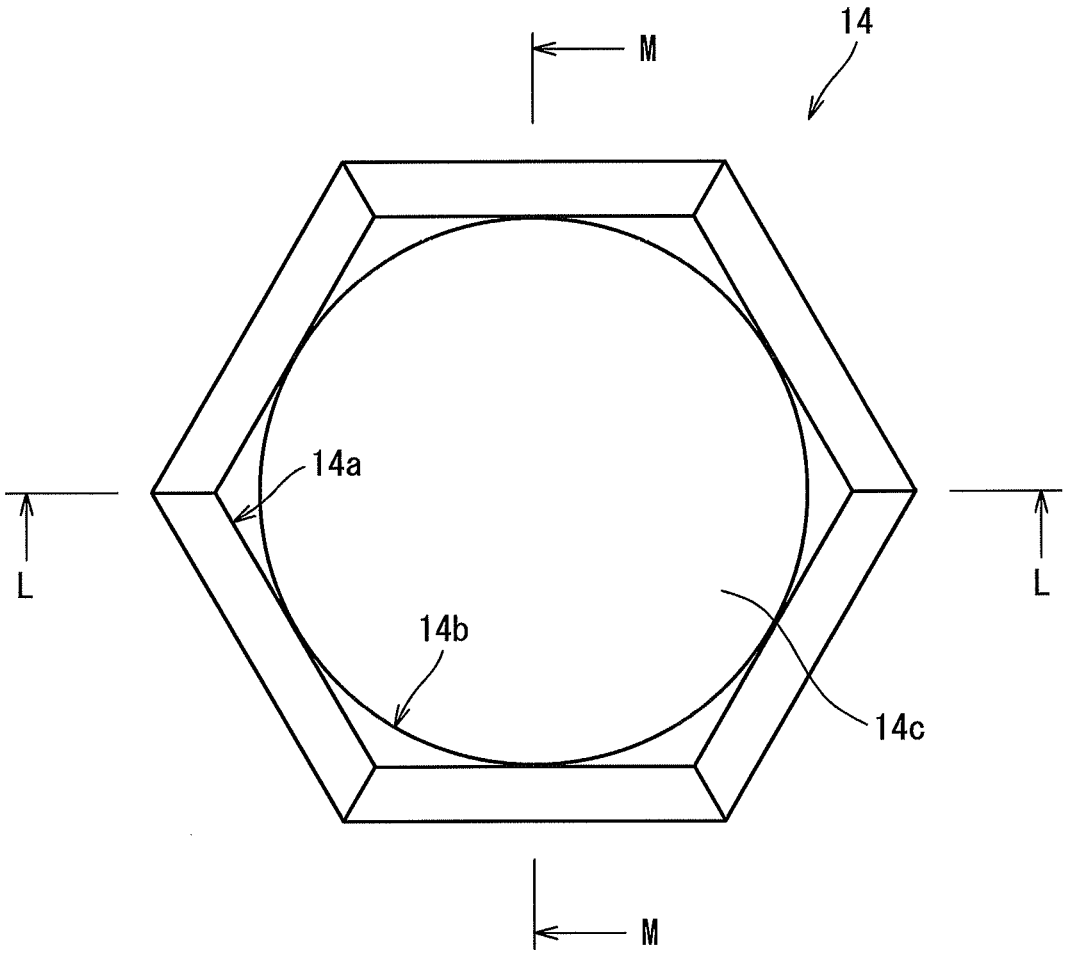
FIG. 23 is a plan view of the recess part for a socket.
Figure 24:
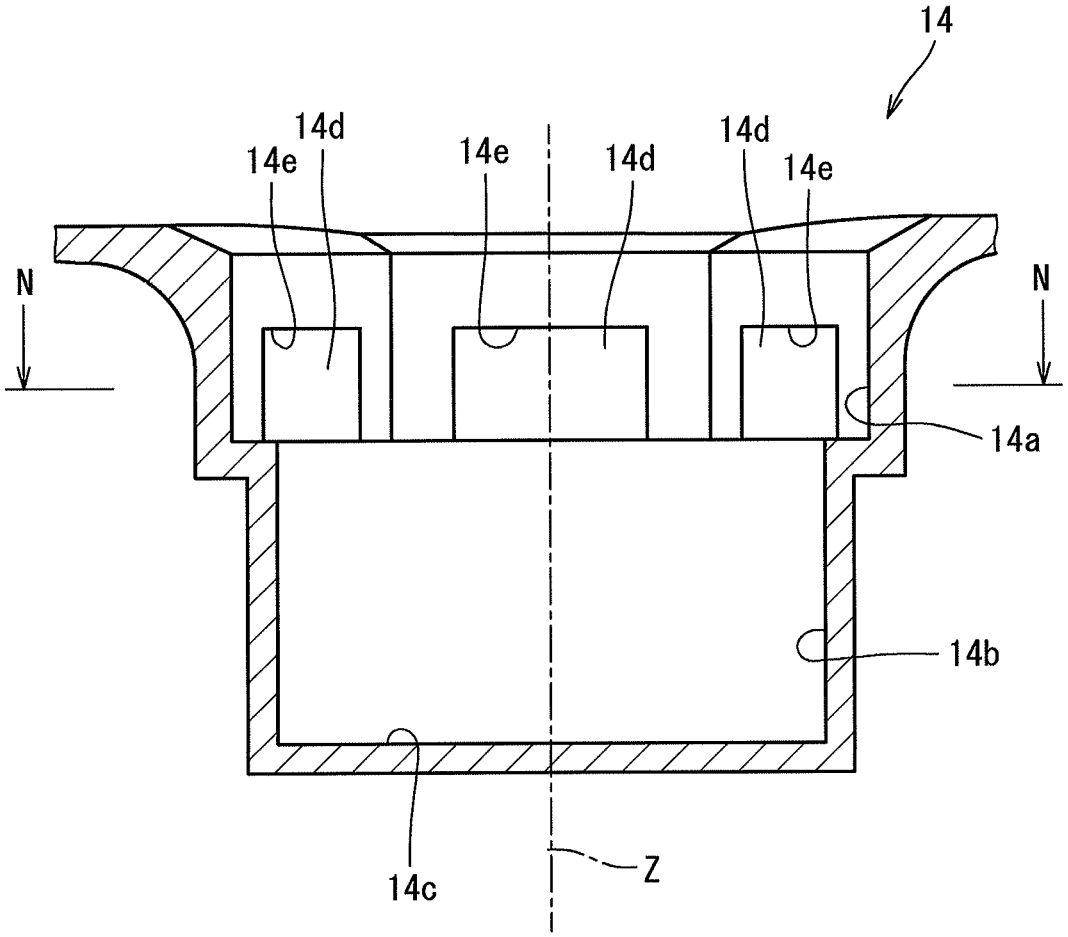
FIG. 24 is a cross-sectional view taken along line L-L of FIG. 23.
Figure 25:
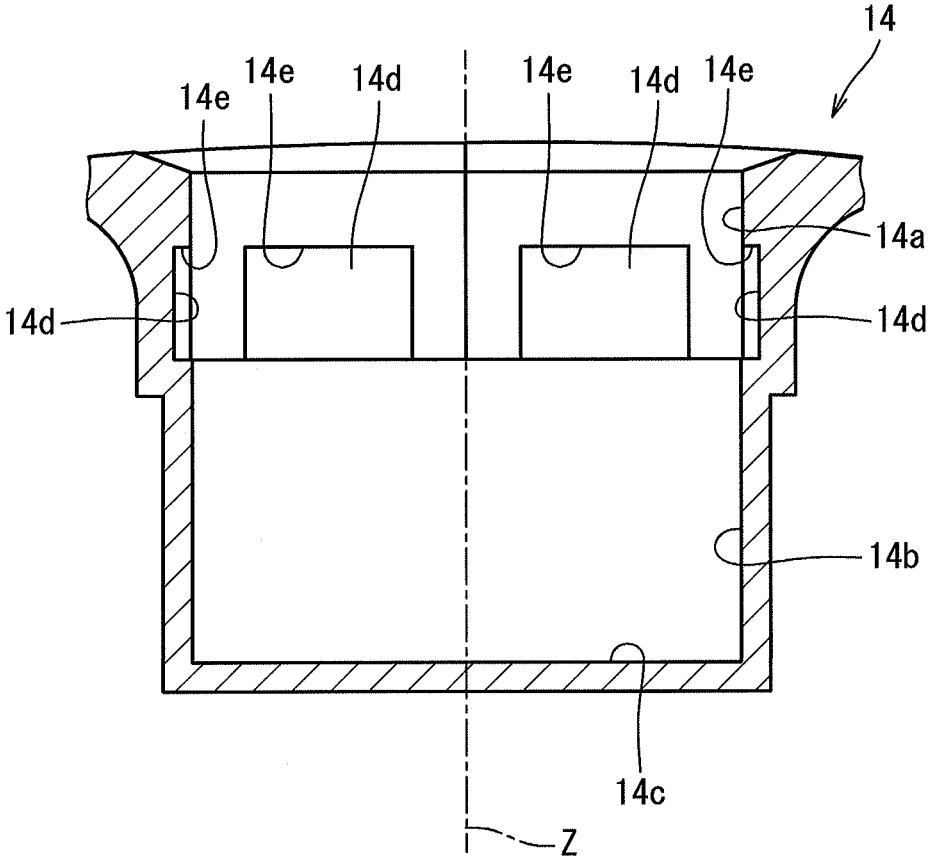
FIG. 25 is a cross-sectional view taken along line M-M of FIG. 23.
Figure 26:
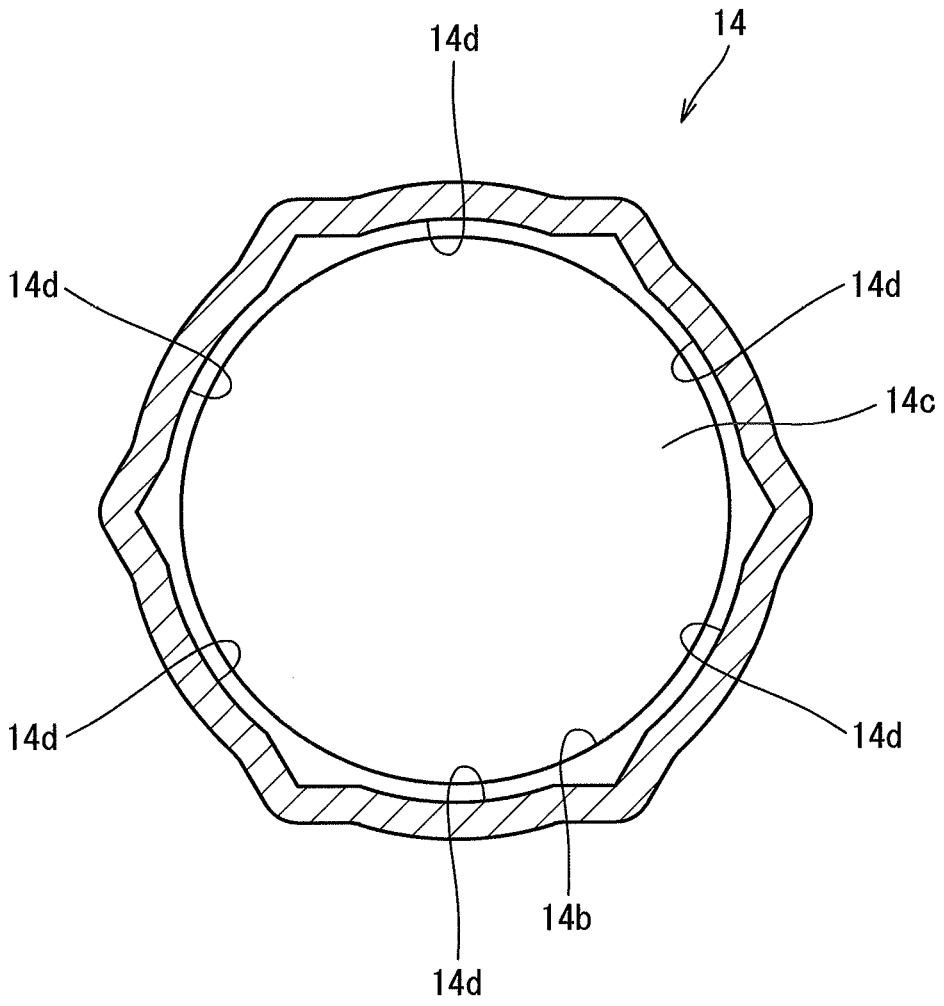
FIG. 26 is a cross-sectional view taken along line N-N of FIG. 24.

FIG. 23 is a plan view of the recess part 14 for a socket. FIG. 24 is a cross-sectional view taken along line L-L of FIG. 23. FIG. 25 is a cross-sectional view taken along line M-M of FIG. 23. FIG. 26 is a cross-sectional view taken along line N-N of FIG. 24.

The recess part 14 for a socket includes a polygonal inner surface 14*a*. Furthermore, the recess part 14 for a socket includes a circumferential inner surface 14*b* and a bottom face 14*c*. In the recess part 14 for a socket, the circumferential inner surface 14*b* is positioned on a deeper side than the polygonal inner surface 14*a*.

The sectional shape of the polygonal inner surface 14*a* is a polygon. Preferably, the sectional shape of the polygonal inner surface 14*a* is a regular polygon. In the embodiment, the sectional shape of the polygonal inner surface 14*a* is a regular hexagon. The sectional shape of the polygonal inner surface 14*a* corresponds to the sectional shape of the outer surface 11*b* of the wall-like part 11.

The polygonal inner surface 14*a* has the same shape as that of the polygonal outer surface 11*b* of the socket 10. The polygonal inner surface 14*a* is in surface contact with the polygonal outer surface 11*b*. For this reason, the anti-rotation of the socket 10 is attained.

As shown in FIG. 25, the recess part 14 for a socket includes an undercut part 14*d*. The undercut part 14*d* is provided on the side surface of the recess part 14 for a socket. The undercut part 14*d* is provided on the polygonal inner surface 14*a*. The undercut part 14*d* is a recess part extending in the axial perpendicular direction. The undercut part 14*d* includes an upper bump surface 14*e*.

The undercut part 14*d* is formed by cutting. For example, the undercut part 14*d* is formed by rotating an L-shaped or T-shaped cutter. As shown in FIG. 26, the thickness of the side surface of the recess part 14 for a socket is substantially constant. Before the undercut part 14*d* is cut, a portion on which the undercut part 14*d* is provided is thickened. As a result, even in an end state where the undercut part 14*d* is provided, the portion where the undercut part 14*d* is formed is not thinner than the other portion.

Figure 27:
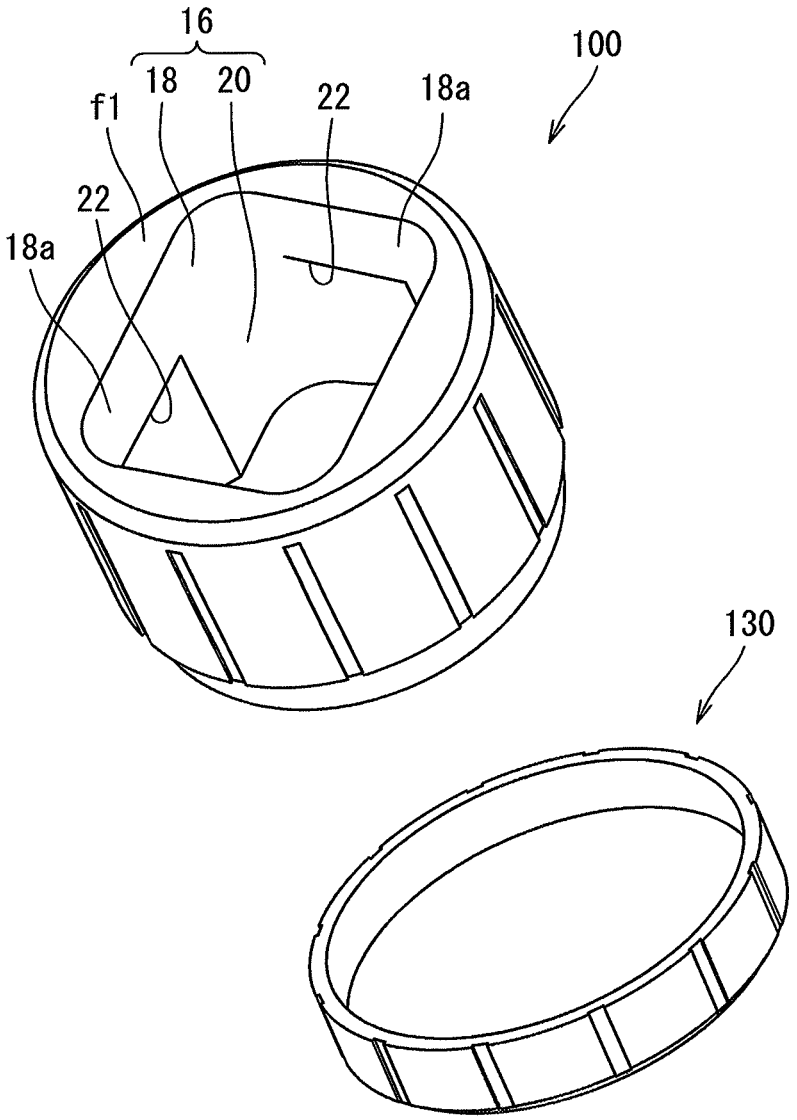
FIG. 27 is an exploded perspective view showing a socket and a bottom face forming part according to a second embodiment.
Figure 28:
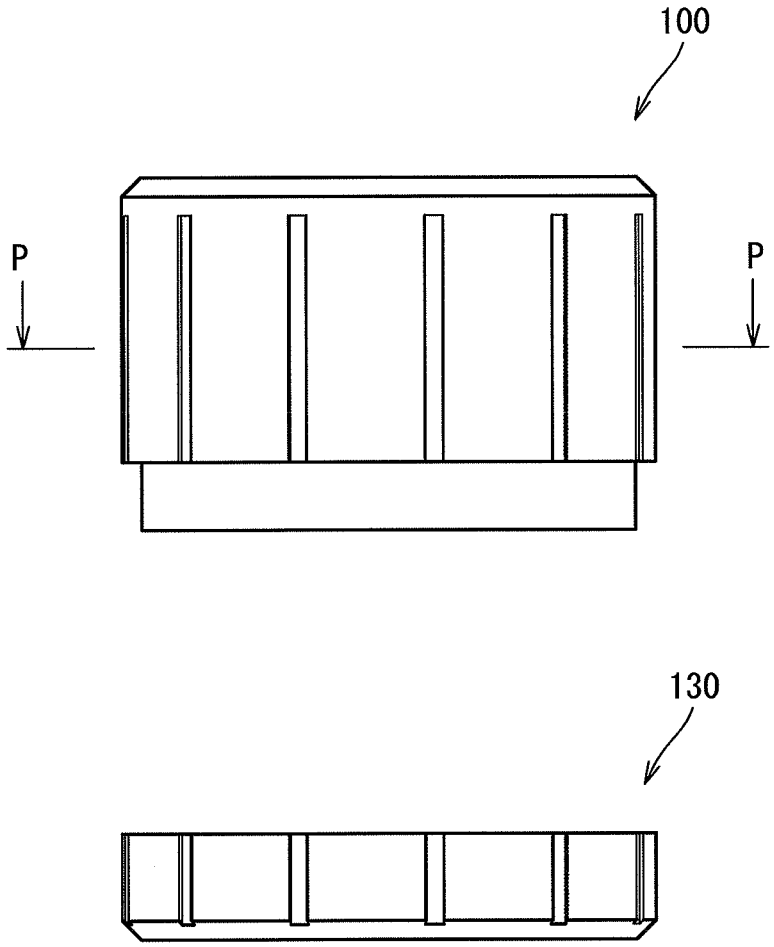
FIG. 28 is a side view showing the socket and the bottom face forming part shown in FIG. 27.
Figure 29:
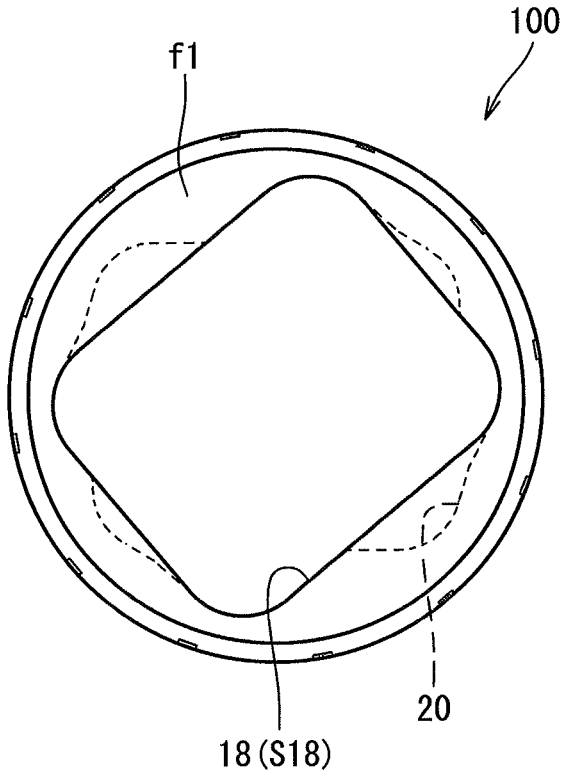
FIG. 29 is a plan view of the socket shown in FIG. 27.
Figure 30:
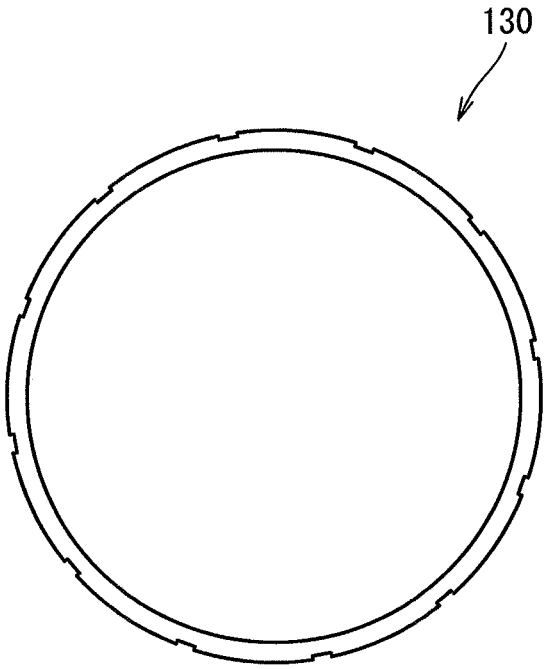
FIG. 30 is a bottom view of the bottom face forming part shown in FIG. 27.
Figure 31:
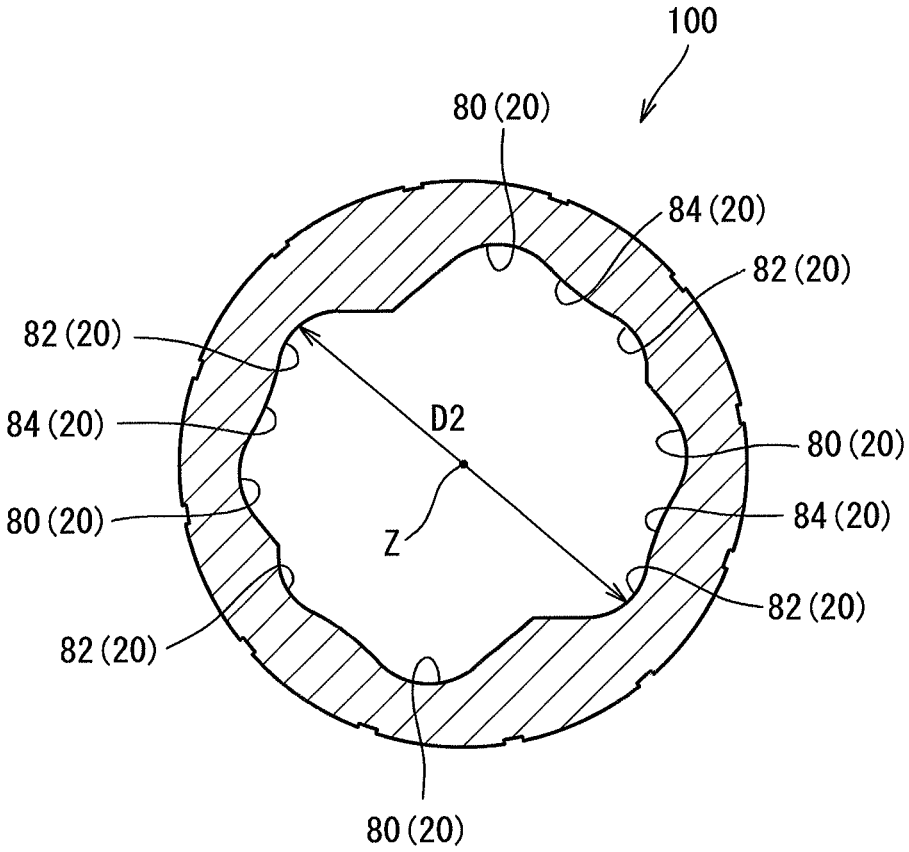
FIG. 31 is a cross-sectional view taken along line P-P of FIG. 28.

FIG. 27 is an exploded perspective view of a socket 100 and a bottom face forming part 130 as a modification. FIG. 28 is a side view of the socket 100 and the bottom face forming part 130. FIG. 29 is a plan view of the socket 100. FIG. 30 is a bottom view of the bottom face forming part 130. FIG. 31 is a cross-sectional view taken along line P-P of FIG. 28.

The bottom face forming part 130 is the same as the bottom face forming part 13.

The socket 100 includes a hole 16. The hole 16 extends through the socket 100. The shape of the hole 16 is the same as the hole 16 of the socket 10. The material of the socket 100 is the same as that of the socket 10.

The socket 100 includes no wall-like part 11. The socket 100 may be used in place of the socket 10. The weight body 12 can be used also for the socket 100. When the socket 100 and the bottom face forming part 130 are used, it is preferable that the recess part 14 for a socket includes no polygonal inner surface 14*a*.

[Wall-Like Part]

At the engaging position EP, the wall-like part 11 is interposed in at least a part of a space positioned between the exposed part E1 of the weight body 12 and the head body h1. Therefore, sound caused by collision of the weight body 12 and the head body h1 is prevented.

At the engaging position EP, the wall-like part 11 is not engaged with the weight body 12. At the engaging position EP, the wall-like part 11 is not engaged with the exposed part E1. Even when the wall-like part 11 is in contact with the weight body 12, the wall-like part 11 has no effect of locking the weight body 12. The wall-like part 11 does not bear the securement of the weight body 12.

The impact shock caused by hitting may vibrate the weight body 12. The amplitude of the vibration is apt to be increased in the exposed part E1 (head part 28). This is because the exposed part E1 is in a state where it is apt to be relatively moved without being engaged with the wall-like part 11. The wall-like part 11 can effectively absorb the vibration of the exposed part E1 (head part 28). Impact shock absorbing performance can be improved by suppressing the vibration of a portion which is apt to be vibrated. The impact shock absorbing performance can contribute to improvement in hit ball feeling. The hit ball feeling can be improved by the wall-like part 11. Since the wall-like part 11 does not bear the securement of the weight body 12, the wall-like part 11 is likely to be deformed. Therefore, the vibration absorbing performance can be effectively improved by the wall-like part 11.

As described above, the wall-like part 11 includes the engaging projection part kp1 (see FIG. 3). The engaging projection part kp1 is engaged with the undercut part 14*d*. The socket 10 and the recess part 14 for a socket are bonded by an adhesive agent. Even if the adhesive agent is not used, the socket 10 is less likely to be disengaged by the engagement of the engaging projection part kp1 and the undercut part 14*d*.

In the embodiment, the outer surface 11*h* of the socket 10 is a polygonal outer surface. In the embodiment, the sectional shape of the polygonal outer surface 11*b* is a regular polygon. The regular polygon is a regular hexagon. On the polygonal outer surface 11*b*, a plurality of planes b1, b2, b3, b4, b5, and b6 corresponding to respective sides of the polygon are formed (see FIG. 4). The engaging projection part kp1 is provided on each of the planes b1 to b6. The undercut part 14*d* engaged with each of the engaging projection parts kp1 is provided. Thus, the engaging parts of the engaging projection parts kp1 and the undercut parts 14*d* are provided at a plurality of places around the socket 10. For this reason, the socket 10 is less likely to be disengaged.

In the embodiment, the undercut part 14*d* is the recess part. However, the undercut part 14*d* is not limited to the configuration. The undercut part 14*d* is a portion capable of forming undercut in the coming-off direction of the socket 10. In the embodiment, the coming-off direction of the socket 10 is the direction of the axis line Z.

When the engaging projection part kp1 is engaged with the undercut part 14*d*, the elastic deformation of the wall-like part 11 is produced. The elastic deformation is also referred to as elastic deformation X. In the elastic deformation X, the wall-like part 11 is fallen to the center side of the socket 10. In other words, in the elastic deformation X, the wall-like part 11 is fallen to the axis line Z side. The engaging projection part kp1 can be engaged with the undercut part 14*d* by the deformation. In a state where the engaging projection part kp1 is engaged with the undercut part 14*d*, the elastic deformation X may be dissolved, or the elastic deformation X may remain. In the embodiment, the elastic deformation X is dissolved in a state where the engaging projection part kp1 is engaged with the undercut part 14*d*.

When the elastic deformation X is produced, the weight body 12 is not attached to the socket 10. In this case, the weight body 12 does not inhibit the elastic deformation X.

As described above, the socket 10 includes the lack part ms1. The elastic deformation X is facilitated by the lack part ms1. The material of the socket 10 may be relatively hard, and the material may have high rigidity. Even in this case, the elastic deformation X is facilitated by the existence of the lack part ms1. Therefore, the socket 10 is easily attached to the recess part 14 for a socket.

In respect of the elastic deformation X, the width of the lack part ms1 is preferably equal to or greater than 0.5 mm, and more preferably equal to or greater than 0.8 mm. In respects of suppressing invasion of a foreign substance and of appearance, the width of the lack part ms1 is preferably equal to or less than 1.5 mm, and more preferably equal to or less than 1.2 mm.

In respect of the elastic deformation X, the depth of the lack part ms1 is preferably equal to or greater than 1 mm, more preferably equal to or greater than 1.5 mm, and still more preferably equal to or greater than 2.0 mm. When the lack part ms1 is excessively deep, it is necessary to heighten the lack part ms1. In this case, the recess part 14 for a socket is deepened, which is apt to make the recess part 14 for a socket heavier. In this respect, the depth of the lack part ms1 is preferably equal to or less than 4 mm, more preferably equal to or less than 3.5 mm, and still more preferably equal to or less than 3.0 mm.

The number of the lack parts ms1 is preferably 2 or greater and 6 or less. If the plurality of lack parts ms1 are provided, the plurality of lack parts ms1 are preferably disposed at equal intervals.

In the embodiment, the plane shape of the polygonal outer surface 11*b* is a hexagon. If the plane shape of the polygonal outer surface 11*b* is an n-polygon, n is preferably 4 or greater and 8 or less. As n is greater, the wall-like part 11 is likely to be thinned, which is advantageous for the weight saving of the socket 10. In this respect, n is more preferably 6. At least one engaging projection part kp1 is preferably provided on each of the sides of the n-polygon. More preferably, the number of the engaging projection parts kp1 is n.

In respect of the elastic deformation X, the height of the wall-like part 11 is preferably equal to or greater than 1 mm, more preferably equal to or greater than 1.5 mm, and still more preferably equal to or greater than 2.0 mm. In respect of preventing the recess part 14 for a socket from being excessively deepened, the height of the wall-like part 11 is preferably equal to or less than 4 mm, more preferably equal to or less than 3.5 mm, and still more preferably equal to or less than 3.0 mm. The height of the wall-like part 11 is measured along the direction of the axis line Z.

In respect of facilitating the elastic deformation X, a position where the height of the engaging projection part kp1 is maximum is preferably above the central position of the height of the wall-like part 11. For example, when the height of the wall-like part 11 is 4.0 mm, the central position of the height of the wall-like part 11 is a position where a height from the root side of the wall-like part 11 is 2.0 mm. In this case, a position where the height of the engaging projection part kp1 is maximum is preferably above the position of 2.0 mm. In the embodiment, the height of the engaging projection part kp1 is measured along the direction of a straight line Lp to be described later.

An engaging width between the engaging projection part kp1 and the undercut part 14*d* is shown by a double pointed arrow W1 in FIG. 19. The engaging width is measured along a direction perpendicular to the coming-off direction of the socket 10. In the embodiment, the perpendicular direction is a direction of the straight line Lp (see FIG. 16) intersecting with the axis line Z and being perpendicular to the axis line Z. As shown in FIG. 3, in the embodiment, the outer surface of the engaging projection part kp1 is a curved surface. The engaging width is not constant. In light of the point, the maximum value of the engaging width in one engaging projection part kp1 is the engaging width W1. When a plurality of engaging projection parts kp1 exist as shown in the embodiment, the number of the engaging widths W1 may be also plural. In this case, the average value of the plurality of values is employed as the engaging width W1.

A clearance distance between the wall-like part 11 and the weight body 12 is shown by a double pointed arrow W2 in FIG. 20. A method for measuring the clearance distance W2 is the same as the method for measuring the engaging width W1. The clearance distance W2 is measured along the direction of the straight line Lp. When the clearance distance is not constant, an average value is employed as the clearance distance W2. The clearance distance W2 is measured at the engaging position EP.

In the embodiment, the clearance distance W2 is less than the engaging width W1. Therefore, the elastic deformation X is inhibited by the existence of the weight body 12. The weight body 12 is secured to the socket 10 at the engaging position EP. At the engaging position EP, the elastic deformation X is not caused because of W2<W1. For this reason, the socket 10 to which the weight body 12 is attached is less likely to be disengaged from the recess part 14 for a socket. When the socket 10 is attached to the recess part 14 for a socket, the weight body 12 is detached from the socket 10. Therefore, the weight body 12 does not inhibit the elastic deformation X, which facilitates the attachment of the socket 10.

In the embodiment, the outer surface 11*b* of the wall-like part 11 abuts on the polygonal inner surface 14*a* of the recess part 14 for a socket. In the embodiment, the clearance distance W2 is zero. In the embodiment, the elastic deformation X is prevented at the engaging position EP. Therefore, the disengagement of the socket 10 is effectively suppressed.

In respect of suppressing the disengagement of the socket 10, the engaging width W1 is preferably equal to or greater than 0.2 mm, more preferably equal to or greater than 0.3 mm, and still more preferably equal to or greater than 0.4 mm. In respect of easily attaching the socket 10 to the recess part 14 for a socket, the engaging width W1 is preferably equal to or less than 1.0 mm, more preferably equal to or less than 0.8 mm, and still more preferably equal to or less than 0.6 mm.

As shown in FIG. 16, the sectional shape of the engaging part 32 is a substantially rectangle. The term "substantially" means that the modification of the corner part is allowed. Modification examples of the corner part include a chamfered corner part in addition to the rounded corner part shown in the embodiment.

The sectional shape of the engaging part 32 has N-fold rotation symmetry with the axis line Z as a rotation axis. N is an integer of 1 or greater and 3 or less. In the substantially rectangle of the embodiment, N is 2. That is, the substantially rectangle has 2-fold rotation symmetry.

The N-fold rotation symmetry means that a shape after being rotated by (360/N) degrees about the rotation axis coincides with that before being rotated. N is a positive integer. In other words, N is an integer of equal to or greater than 1. Preferably, N is an integer of 1 or greater and 3 or less. In the general definition of rotation symmetric property, N is an integer of equal to or greater than 2. However, in the present application, N includes 1. When N is 1 in the general definition, the shape has no rotation symmetric property. In the sectional shape of the engaging part 32, N may be 1.

In Japanese Utility Model Application Publication No. 3142270 described above, the sectional shape of the engaging part is a substantially square. In Japanese Utility Model Application Publication No. 3142270, N is 4. As shown in FIGS. 5 to 7 in Japanese Utility Model Application Publication No. 3142270, when the sectional shape of the engaging part is a substantially square, the reverse rotation suppressing part Rx and the excess rotation suppressing part Ry are apt to be decreased in size (see FIG. 21). Therefore, the reverse rotation and the excess rotation are apt to be produced. The reverse rotation suppressing part Rx and the excess rotation suppressing part Ry are apt to be increased in size by setting N to be equal to or less than 3. Therefore, the reverse rotation and the excess rotation are effectively suppressed.

As shown in FIGS. 6 and 7 in Japanese Utility Model Application Publication No. 3142270, when N is 4, the reverse rotation suppressing part Rx is gotten over by the reverse rotation of 45 degrees, which can realize the engaging position EP. Therefore, the engaging position EP is relatively easily realized also by the reverse rotation. This may increase an opportunity in which the reverse rotation suppressing part Rx is damaged by the reverse rotation. In other words, an opportunity of misuse may be increased. When N is equal to or less than 3, reverse rotation having a large angle is required in order to get over the reverse rotation suppressing part Rx, to lead to the engaging position EP. Therefore, the opportunity in which the reverse rotation suppressing part Rx is damaged is less likely to be produced. As N is smaller, the reverse rotation suppressing effect is increased.

The case of the excess rotation is also the same. In the embodiment of Japanese Utility Model Application Publication No. 3142270, the excess rotation suppressing part Ry may be gotten over by the excess rotation of 45 degrees. Although the transition to the engaging position EP is intended in this case, the engaging position EP is passed, to lead to the non-engaging position NP. Thus, the pass of the engaging position EP caused by the excess rotation is relatively easily realized. This may increase an opportunity in which the excess rotation suppressing part Ry is damaged. When N is equal to or less than 3, excess rotation having a large angle is required in order to get over the excess rotation suppressing part Ry, to lead to the non-engaging position NP. Therefore, the opportunity in which the excess rotation suppressing part Ry is damaged is less likely to be produced. As N is smaller, the excess rotation suppressing effect is increased.

Thus, N is set to be equal to or less than 3, and thereby, an angle of rotation required for the reverse rotation and the excess rotation can be increased. In addition, the reverse rotation suppressing part Rx and the excess rotation suppressing part Ry can be increased in size. Therefore, the reverse rotation and the excess rotation can be effectively decreased. For this reason, the reverse rotation suppressing part Rx and the excess rotation suppressing part Ry are less likely to be damaged. As a result, the socket 10 is less likely to be deteriorated through repeated use.

More preferably N is set to 2. In this case, the sectional shape of the engaging part 32 is relatively simplified as compared with the case where N is 1. Therefore, the engaging part 32 and the socket 10 are easily designed. The engaging part 32 can be easily inserted into the first hole part 18 as compared with the case where N is 1. Examples when N is 2 include a substantially parallelogram in addition to the substantially rectangle shown in the embodiment.

In the present application, the longest rotation radius of the engaging part 32 is defined as R1. The shortest rotation radius of the engaging part 32 is defined as R2. The radius R1 is as described above. That is, as shown in FIG. 21, the radius R1 is a distance between a rotation center Z and the point Pf. The radius R2 is a distance between the rotation center Z and a point Pc. The point Pc is a point nearest to the point Z in the outline of the section of the engaging part 32 (see FIG. 21).

In respect of increasing the reverse rotation suppressing part Rx and the excess rotation suppressing part Ry in size, R1/R2 is preferably equal to or greater than 1.30, more preferably equal to or greater than 1.33, and still more preferably equal to or greater than 1.36. In respect of decreasing the recess part 14 for a socket, and the socket 10 in size, R1/R2 is preferably equal to or less than 1.70, more preferably equal to or less than 1.60, and still more preferably equal to or less than 1.50. In the embodiment, R1/R2 is 1.39.

A cross-sectional area X of the reverse rotation suppressing part Rx is shown by crosshatching in the cross-sectional view of the non-engaging position NP of FIG. 21. In respect of suppressing the reverse rotation, the cross-sectional area X is preferably equal to or greater than 1.5 $mm^2$, more preferably equal to or greater than 2.0 $mm^2$, and still more preferably equal to or greater than 2.5 $mm^2$. In respect of decreasing the recess part 14 for a socket, and the socket 10 in size, the cross-sectional area X is preferably equal to or less than 5.0 $mm^2$, more preferably equal to or less than 4.5 $mm^2$, and still more preferably equal to or less than 4.0 $mm^2$. The cross-sectional area X is the cross-sectional area of one reverse rotation suppressing part Rx.

A cross-sectional area Y of the excess rotation suppressing part Ry is shown by crosshatching in the cross-sectional view of the engaging position EP of FIG. 21. In respect of suppressing the excess rotation, the cross-sectional area Y is preferably equal to or greater than 1.5 $mm^2$, more preferably equal to or greater than 2.0 $mm^2$, and still more preferably equal to or greater than 2.5 $mm^2$. In respect of decreasing the recess part 14 for a socket, and the socket 10 in size, the cross-sectional area Y is preferably equal to or less than 5.0 $mm^2$, more preferably equal to or less than 4.5 $mm^2$, and still more preferably equal to or less than 4.0 $mm^2$. The cross-sectional area Y is the cross-sectional area of one excess rotation suppressing part Ry.

The maximum height of the reverse rotation suppressing part Rx is shown by a double pointed arrow R3 in FIG. 21. The height R3 is measured along a radial direction. The radial direction is the direction of the straight line Lp. In respect of suppressing the reverse rotation, R3/R1 is preferably equal to or greater than 0.19, more preferably equal to or greater than 0.20, and still more preferably equal to or greater than 0.21. In respects of the size decrease and weight saving of the recess part 14 for a socket, and the socket 10, R3/R1 is preferably equal to or less than 0.24, more preferably equal to or less than 0.23, and still more preferably equal to or less than 0.22.

The maximum height of the excess rotation suppressing part Ry is shown by a double pointed arrow R4 in FIG. 21. The height R4 is measured along a radial direction. The radial direction is the direction of the straight line Lp. In respect of suppressing the excess rotation, R4/R1 is preferably equal to or greater than 0.19, more preferably equal to or greater than 0.20, and still more preferably equal to or greater than 0.21. In respects of the size decrease and weight saving of the recess part 14 for a socket, and the socket 10, R4/R1 is preferably equal to or less than 0.24, more preferably equal to or less than 0.23, and still more preferably equal to or less than 0.22.

A maximum torque (N·m) required in attaching/detaching under an environment of 40° C. is defined as T40. A maximum torque (N·m) required in attaching/detaching under an environment of 25° C. is defined as T25. A maximum torque (N·m) required in attaching/detaching under an environment of 5° C. is defined as T5. In respect of enabling smooth attachment/detachment regardless of a temperature, a ratio (T40/T5) is preferably equal to or greater than 0.30, more preferably equal to or greater than 0.35, still more preferably equal to or greater than 0.40, and yet still more preferably equal to or greater than 0.41.

In respect of enabling smooth attachment/detachment regardless of a temperature, a ratio (T25/T5) is preferably equal to or greater than 0.57, more preferably equal to or greater than 0.60, and still more preferably equal to or greater than 0.61. As described above, the ratio (T25/T5) is considered to be equal to or less than 1 as in the ratio (T40/T5).

In respect of enabling smooth attachment/detachment at a low temperature, the maximum torque T5 is preferably equal to or less than 6.3 (N·m), more preferably equal to or less than 6.0 (N·m), still more preferably equal to or less than 5.5 (N·m), and yet still more preferably equal to or less than 5.0 (N·m).

In respect of ensuring securement at a high temperature, the maximum torque T40 is preferably equal to or greater than 1.0 (N·m), more preferably equal to or greater than 1.5 (N·m), and still more preferably equal to or greater than 1.8 (N·m).

[Hardness Hs of Socket]

In respect of certainly securing the weight body 12 to suppress sound in hitting, the hardness Hs of the socket 10 is preferably equal to or greater than D40, more preferably equal to or greater than D42, and still more preferably equal to or greater than D45. In respect of suppressing wear caused by the weight body 12, the hardness Hs is preferably equal to or less than D80, more preferably equal to or less than D78, and still more preferably equal to or less than D76.

The hardness Hs is measured in accordance with regulation of "ASTM-D 2240-68" by using a Shore D type hardness scale attached to an automated rubber hardness measuring device ("P1" (trade name) manufactured by Koubunshi Keiki Co., Ltd.) The shape of a measurement sample is set to a cube having a side length of 3 mm. Measurement is performed under a temperature of 23° C. When possible, the measurement sample is cut out from the socket 10. When it is difficult to cut out the measurement sample, a measurement sample made of the same resin composition as that of the socket 10 is used.

When a ball is hit with the golf club 2, hitting vibration is transmitted to golf player's hands via the golf club 2. The vibrational energy of the hitting vibration is transformed into the kinetic energy of the weight body 12 housed in the socket 10. The socket 10 and the weight body 12 transform the vibrational energy of the shaft 6 into the kinetic energy of the weight body 12, and thereby the hitting vibration can be alleviated. Furthermore, since the vibration of the exposed part E1 of the weight body 12 is absorbed by the wall-like part 11, the vibration absorbing performance is effectively improved.

[Polymer]

In respect of a hardness, the material of the socket is preferably a polymer. Examples of the polymer include a thermosetting polymer and a thermoplastic polymer. Examples of the thermosetting polymer include a phenol resin, an epoxy resin, a melamine resin, a urea resin, an unsaturated polyester resin, an alkyd resin, a thermosetting polyurethane, a thermosetting polyimide, and a thermosetting elastomer. Examples of the thermoplastic polymer include polyethylene, polypropylene, polyvinyl chloride, polystyrene, polytetrafluoroethylene, an ABS resin (acrylonitrile butadiene styrene resin), an acrylic resin, polyamide, polyacetal, polycarbonate, modified polyphenylene ether, polybutylene terephthalate, polyethylene terephthalate, polyphenylene sulfide, polyether ether ketone, a thermoplastic polyimide, polyamide imide, and a thermoplastic elastomer.

Examples of the thermoplastic elastomer include a thermoplastic polyamide elastomer, a thermoplastic polyester elastomer, a thermoplastic polystyrene elastomer, a thermoplastic polyester elastomer, and a thermoplastic polyurethane elastomer.

In respect of durability, a urethane-based polymer and polyamide are preferable, and the urethane-based polymer is more preferable. Examples of the urethane-based polymer include polyurethane and a thermoplastic polyurethane elastomer. The urethane-based polymer may be thermoplastic, or may be thermosetting. In respect of formability, a thermoplastic urethane-based polymer is preferable, and the thermoplastic polyurethane elastomer is more preferable.

In respect of formability, the thermoplastic polymer is preferable. In respect of a hardness and durability, in the thermoplastic polymer, the polyamide and the thermoplastic polyurethane elastomer are preferable, and the thermoplastic polyurethane elastomer is more preferable.

Examples of the polyamide include nylon 6, nylon 11, nylon 12, and nylon 66.

A preferable thermoplastic polyurethane elastomer contains a polyurethane component as a hard segment, and a polyester component or a polyether component as a soft segment. That is, preferable examples of the thermoplastic polyurethane elastomer (TPU) include a polyester-based TPU and a polyether-based TPU. Examples of a curing agent for the polyurethane component include cycloaliphatic diisocyanate, aromatic diisocyanate, and aliphatic diisocyanate.

Examples of the cycloaliphatic diisocyanate include 4,4'-dicyclohexylmethane diisocyanate ($H_{12}$MDI), 1,3-bis(isocyanatomethyl)cyclohexane ($H_6$XDI), isophorone diisocyanate (IPDI), and trans-1,4-cyclohexane diisocyanate (CHDI).

Examples of the aromatic diisocyanate include diphenylmethane diisocyanate (MDI) and toluene diisocyanate (TDI). Examples of the aliphatic diisocyanate include hexamethylene diisocyanate (HDI).

Commercially available examples of the thermoplastic polyurethane elastomer (TPU) include "Elastollan" (trade name) manufactured by BASF Japan Ltd.

Specific examples of the polyester-based TPU include "Elastollan C70A", "Elastollan C80A", "Elastollan C85A", "Elastollan C90A", "Elastollan C95A", and "Elastollan C64D".

Specific examples of the polyether-based TPU include "Elastollan 1164D", "Elastollan 1198A", "Elastollan 1180A", "Elastollan 1188A", "Elastollan 1190A", "Elastollan 1195A", "Elastollan 1174D", "Elastollan 1154D", and "Elastollan ET385".

A fiber reinforced resin containing each of the polymers as a matrix may be used.

EXAMPLES

Hereinafter, the effects of the present invention will be clarified by examples. However, the present invention should not be interpreted in a limited way based on the description of examples.

A head having the same structure as that of the head 2 was produced.

[Production of Head Body]

A face member was obtained by pressing a rolled material made of a titanium alloy (Ti-6Al-4V). A body was obtained by casting using a titanium alloy (Ti-6Al-4V). The body included a recess part for a socket. Ahead body was obtained by welding the obtained face member and body. An undercut part was formed in the side surface of the recess part for a socket by cutting with an L-shaped cutter.

[Production of Socket]

A socket was obtained by injection molding. A thermoplastic polyurethane elastomer was used as the material of the socket. Specifically, a product material obtained by mixing "Elastollan 1164D" with "Elastollan 1198A" at a weight ratio of 1:1 was used. The cross-sectional area X was 3.27 $mm^2$. The cross-sectional area Y was 3.27 $mm^2$.

[Production of Weight Body]

A tungsten nickel alloy (W—Ni alloy) was used as the material of a weight body. The W—Ni alloy was molded by powder sintering, to obtain the weight body.

[Attachment of Socket to Recess Part for Socket]

The socket was bonded to the recess part for a socket using an adhesive agent. "DP460" (trade name) manufactured by Sumitomo 3M Ltd. was used for the bonding. An engaging projection part of the socket was engaged with the undercut part in parallel with the bonding. In the engagement, the engaging projection part was fitted into the undercut part while a wall-like part of the socket is elastically deformed. Thus, a head of example was obtained.

In the head, the socket was easily attached to the recess part for a socket by utilizing the elastic deformation of the wall-like part. The weight body was inserted into the socket, and was rotated by +θ°. The tool described above was used for the rotation. As a result, the weight body was easily secured to the socket. Reverse rotation from a state (non-engaging position NP) where the weight body was inserted was difficult. Excess rotation from an engaging position was also difficult.

The invention described above can be applied to all golf clubs. The present invention can be used for a wood type club, a utility type club, a hybrid type club, an iron type club, and a putter club or the like.

The description hereinabove is merely for an illustrative example, and various modifications can be made in the scope not to depart from the principles of the present invention.

What is claimed is:

1. A golf club head comprising: a head body including a recess portion for a socket; a socket attached to the recess portion for a socket; and a weight body detachably attached to the socket, wherein the weight body can be secured by relative rotation of an angle +θ° to the socket;

the secured weight body can be detached by relative rotation of an angle −θ° to the socket;

the weight body includes an engaging portion for engaging the socket, wherein a distance between a central point and a point farthest from the central point in an outline of a section of the engaging portion is defined as R1, a distance between a central point and a point nearest to the central point in an outline of a section of the engaging portion is defined as R2, and the ratio R1:R2 ranges from 1.30 through 1.70 inclusive;

the socket includes a first hole and a second hole positioned on a deeper side than the first hole, wherein said second hole includes a reverse rotation suppressing portion which protrudes inwardly, configured such that engaging portion distance R1 and a maximum height of the reverse rotation suppressing portion R3 have a ratio R3:R1 equal to or greater than 0.19, and said second hole includes an excess rotation suppressing portion which protrudes inwardly, configured such that engaging portion distance R1 and a maximum height of the excess rotation suppressing portion R4 have a ratio R4:R1 equal to or greater than 0.19;

the engaging portion is movable into an engaging position EP and a non-engaging position NP at the second hole;

assuming that rotation of the weight body is rotation about an axis line Z, the engaging portion has a sectional shape with N-fold rotation symmetry with the axis line Z as a rotation axis, wherein N-fold rotation symmetry signifies that a cross-sectional shape after being rotated by 360/N degrees about a rotation axis coincides with the cross-sectional shape before such rotation; and the maximum value of N is 1, 2, or 3.

2. The golf club head according to claim 1, wherein the maximum value of N is 2.

3. The golf club head according to claim 2, wherein the sectional shape of the engaging portion is substantially rectangular.

4. The golf club head according to claim 1, wherein the recess portion for a socket includes an undercut portion;

the socket includes an engaging projection portion; and the undercut portion and the engaging projection portion are engaged with each other.

5. The golf club head according to claim 4, wherein the recess portion for a socket includes a polygonal inner surface, and the undercut portion is provided on the polygonal inner surface.

6. The golf club head according to claim 4, wherein the socket includes a wall portion;

the wall portion forms an upper end portion of the socket; and the wall portion includes the engaging projection portion.

7. The golf club head according to claim 6, wherein the wall portion includes an aperture.

8. The golf club head according to claim 6, wherein if an engaging width between the undercut portion and the engaging projection portion is defined as W1, and a clearance distance between the wall portion and the weight body is defined as W2, the clearance distance W2 is less than the engaging width W1.

9. The golf club head according to claim 8, wherein the engaging width W1 ranges from 0.2 mm through 1.0 mm inclusive.

10. The golf club head according to claim 3, wherein the rectangle is not a square.

* * * * *